US011839290B1

(12) United States Patent
Lynch

(10) Patent No.: US 11,839,290 B1
(45) Date of Patent: Dec. 12, 2023

(54) HANDLE SYSTEM FOR PORTABLE ELECTRONIC DEVICE CASE

(71) Applicant: Pioneer Square Brands, Inc., Seattle, WA (US)

(72) Inventor: Riley Edwin Lynch, Greensboro, NC (US)

(73) Assignee: Pioneer Square Brands, Inc., High Point, NC (US)

( * ) Notice: Subject to any disclaimer, the term of this patent is extended or adjusted under 35 U.S.C. 154(b) by 0 days.

(21) Appl. No.: 18/211,743

(22) Filed: Jun. 20, 2023

(51) Int. Cl.
*A45F 5/10* (2006.01)
*A45F 5/00* (2006.01)
*A45C 11/00* (2006.01)

(52) U.S. Cl.
CPC ..... *A45F 5/00* (2013.01); *A45C 11/00* (2013.01)

(58) Field of Classification Search
CPC ..... A45F 5/10; A45F 2200/0516; A45F 2200/0525; A45C 13/26; A45C 13/22; A45C 2011/003; A45C 2011/002; H04M 1/0279; H04M 1/0281; Y10S 206/815; Y10S 224/93; H04B 2001/3861; F16B 9/058; Y10T 403/7111
See application file for complete search history.

(56) References Cited

U.S. PATENT DOCUMENTS

| | | | | | |
|---|---|---|---|---|---|
| 61,859 | A * | 2/1867 | Pease | B25G 1/00 | 294/58 |
| RE24,067 | E * | 10/1955 | Drogin | A45C 13/26 | 16/114.1 |
| 4,794,667 | A * | 1/1989 | Nelson | B25G 1/00 | 294/58 |
| 6,017,106 | A * | 1/2000 | Adams | G06F 1/1616 | 361/679.55 |
| 8,070,026 | B2 * | 12/2011 | Wadsworth | F16M 13/022 | 224/269 |
| 9,388,939 | B2 * | 7/2016 | Girault | F16M 11/105 | |
| 9,551,915 | B2 * | 1/2017 | Clearman | F16M 11/041 | |
| 11,240,359 | B2 * | 2/2022 | Wilson | A45F 5/00 | |
| RE49,702 | E * | 10/2023 | Barnett | A45F 5/10 | 455/575.8 |
| 2011/0299231 | A1 * | 12/2011 | Gaddis, II | H05K 5/023 | 361/679.01 |
| 2015/0008687 | A1 * | 1/2015 | Lindsey | F16M 13/04 | 294/137 |

* cited by examiner

*Primary Examiner* — Adam J Waggenspack
(74) *Attorney, Agent, or Firm* — Grandview Law

(57) ABSTRACT

Systems and methods involve implementations including a bar member with a first and second end portions, first and second elongated side portions extending between the first and second end portions, an elongated top and bottom portions extending between the first and second end portions, wherein the first and second elongated side portions extend between the elongated top portion and the bottom portion, and a device case with an aperture sized, shaped, and position to couple with the bar member is removably couplable with the device case. In addition, other aspects are described in the claims, drawings, and text forming a part of the present disclosure.

20 Claims, 35 Drawing Sheets

HANDLE SYSTEM FOR PORTABLE ELECTRONIC DEVICE CASE

SUMMARY

In one or more aspects a system for a portable electronic device including (I) a bar member including (A) a first end portion, (B) a second end portion, (C) a first elongated side portion extending between the first end portion and the second end portion, (D) a second elongated side portion extending between the first end portion and the second end portion, (E) an elongated top portion extending between the first end portion and the second end portion, and (F) an elongated bottom portion extending between the first end portion and the second end portion, and wherein the first elongated side portion extends between the elongated top portion and the bottom portion, wherein the second elongated side portion extends between the elongated top portion and the bottom portion; and (II) a device case for the portable electronic device, the device case including at least one aperture sized, shaped, and position to couple with the bar member is removably couplable with the device case. Wherein the first elongated side portion includes an elongated groove portion. Wherein the elongated top portion is positioned at least one half inch from the device case with the bar member is coupled with the device case. Wherein the first end portion and the second end portion is positioned at least two inches from one another. Wherein the first elongated side portion and the second elongated side portioned at least one inch from one another. Wherein the first end portion includes an aperture, and wherein the second end portion includes an aperture. Wherein the first end portion includes a raised portion adjacent to the aperture of the first end portion, and wherein the second end portion includes a raised portion adjacent to the aperture of the second end portion. Further including a first pin member and a second pin member, wherein the first pin member being couplable with the second pin member, and wherein the aperture of the first end portion being shaped and sized to receive the first pin member, and wherein the aperture of the second end portion being shaped and sized to receive the second pin member. Wherein further including a first bracket and a second bracket, wherein the first bracket includes an aperture shaped and sized to receive the first pin, and wherein the second bracket includes an aperture shaped and sized to receive the second pin. Further including a elongated strap assembly, wherein the elongated strap assembly includes a first end portion including a first material portion, and wherein the elongated strap assembly includes a second material portion couplable with the first material portion. Wherein the first material portion includes a hook material if the second material portion includes a loop material, and wherein the first material portion includes a loop material if the second material portion includes a hook material. Wherein the first bracket includes a slot to receive the first end portion of the elongated strap assembly, wherein the elongated strap assembly includes a second end portion, wherein the second bracket includes a slot to couple with the second end portion of the elongated strap assembly. Wherein the second end portion of the elongated strap assembly includes one or more portions being stitched together to couple the second end portion of the strap assembly to the second bracket. Wherein the bar member includes at least one clip portion extending away from the elongated bottom portion of the bare member. Wherein the at least one clip portion includes an L-shaped portion, and wherein the at least one clip portion includes a beveled edge. Wherein the case for the portable electronic device includes at least one aperture sized, positioned, and shaped to couple with the at least one clip portion of the bar member.

In one or more aspects a system for a portable electronic device including (I) a bar member including (A) a first end portion, (B) a second end portion, (C) a first elongated side portion extending between the first end portion and the second end portion, (D) a second elongated side portion extending between the first end portion and the second end portion, (E) an elongated top portion extending between the first end portion and the second end portion, (F) an elongated bottom portion extending between the first end portion and the second end portion, and (G) at least one clip portion extending away from the elongated bottom portion of the bar member, wherein the first elongated side portion extends between the elongated top portion and the bottom portion, wherein the second elongated side portion extends between the elongated top portion and the bottom portion; and (II) a device case for the portable electronic device, the device case including at least one aperture sized, shaped, and position to couple with the at least one clip portion of the bar member. Further including the elongated strap assembly includes a first end portion and a second end portion, wherein the at least one bracket includes a slot to receive the first end portion of the elongated strap assembly, wherein the elongated strap assembly includes a second end portion, and wherein the second bracket includes a slot to couple with the second end portion of the elongated strap assembly.

In one or more aspects a system for a portable electronic computing device including (I) a bar member including (A) a first end portion, (B) a second end portion, (C) a first elongated side portion extending between the first end portion and the second end portion, (D) a second elongated side portion extending between the first end portion and the second end portion, (E) an elongated top portion extending between the first end portion and the second end portion, (F) an elongated bottom portion extending between the first end portion and the second end portion, and (G) at least one clip portion extending away from the elongated bottom portion of the bar member, wherein the first elongated side portion extends between the elongated top portion and the bottom portion, wherein the second elongated side portion extends between the elongated top portion and the bottom portion; (II) at least one bracket, wherein the at least one bracket being couplable with the bar member; and (III) an elongated strap assembly, wherein the elongated strap member being couplable with the at least one bracket. Wherein the elongated strap assembly includes a first end portion and a second end portion, wherein the at least one bracket includes a slot to receive the first end portion of the elongated strap assembly, and wherein the second bracket includes a slot to couple with the second end portion of the elongated strap assembly.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of Handle System for Portable Electronic Device Case, articles of manufacture, compositions of matter for same that may provide context, for instance, in introducing one or more processes and/or devices described herein.

DETAILED DESCRIPTION

Figure 1:
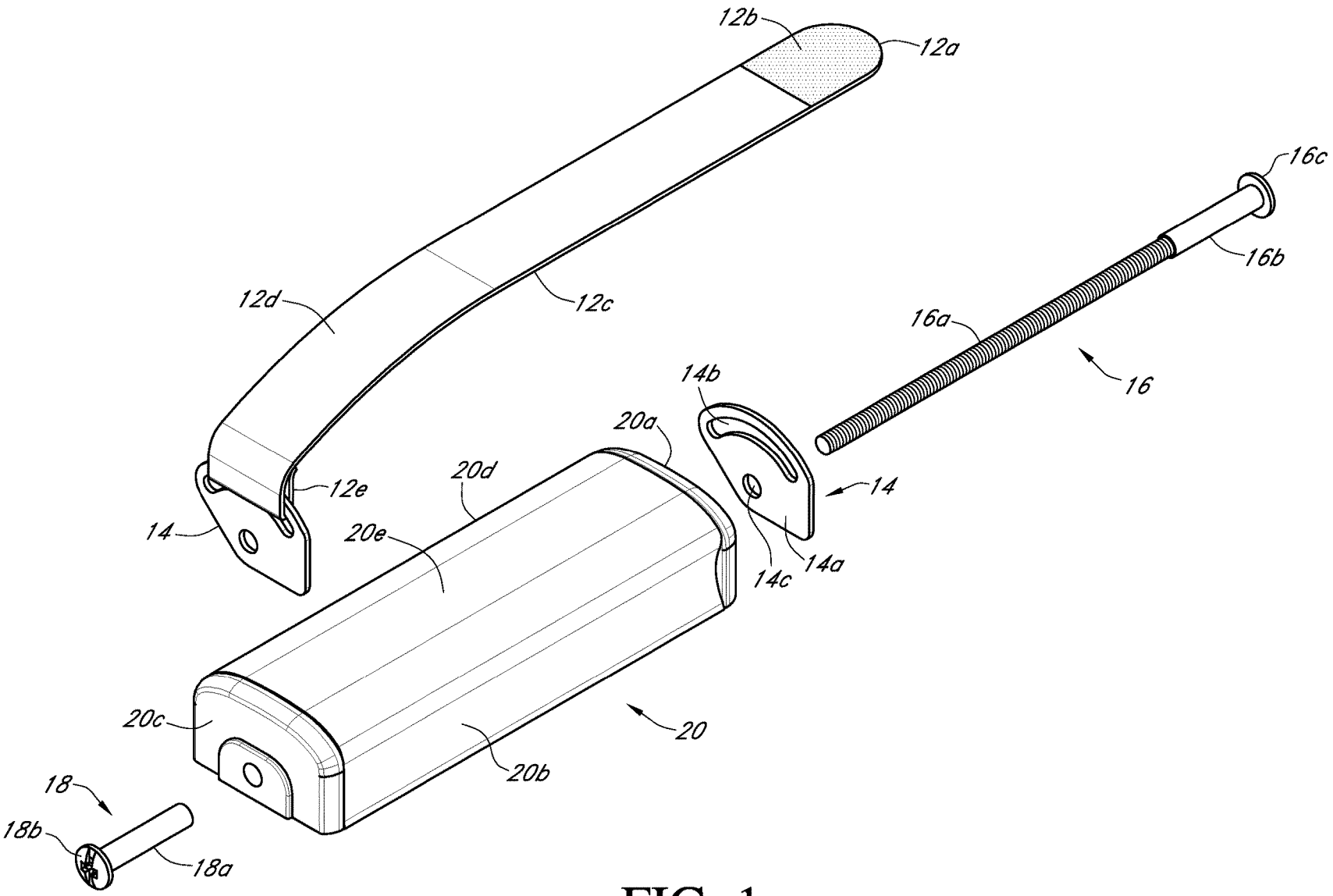
FIG. 1 is an exploded perspective view of a handle assembly.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is an exploded perspective view of handle assembly 10. Depicted implementation of handle assembly 10 is shown to include elongated strap assembly 12, bracket assembly 14, pin member 16, pin member 18, and bar member 20.

Depicted implementation of elongated strap assembly 12 is shown to include tip end portion 12*a*, first material portion 12*b*, second material portion 12*c*, edge portion 12*d*, and stitched end portion 12*e*. In implementations first material portion 12*b* and second material portion 12*c* are made from hook and loop material couplable with each other, respectively, or loop and hook material couplable with each other, respectively.

Depicted implementation of bracket assembly 14 is shown to include main portion 14*a*, curvilinear slot 14*b*, and aperture 14*c*. Depicted implementation of pin member 16 is shown to include rod portion 16*a*, collar portion 16*b*, and head portion 16*c*.

Depicted implementation of pin member 18 is shown to include rod portion 18*a*, and head portion 18*b*. In implementations pin member 16 is couplable with pin member 18. In implementations aperture 14*c* of bracket assembly 14 is shaped and sized to receive pin member 16 and pin member 18.

Depicted implementation of bar member 20 is shown to include end portion 20*a*, elongated side portion 20*b*, end portion 20*c*, elongated side portion 20*d*, and elongated top portion 20*e*. In implementations end portion 20*a* and end portion 20*c* can be positioned at least two inches from one another. In implementations elongated side portion 20*b* and elongated side portion 20*d* can be positioned at least one inch from one another.

Figure 2:
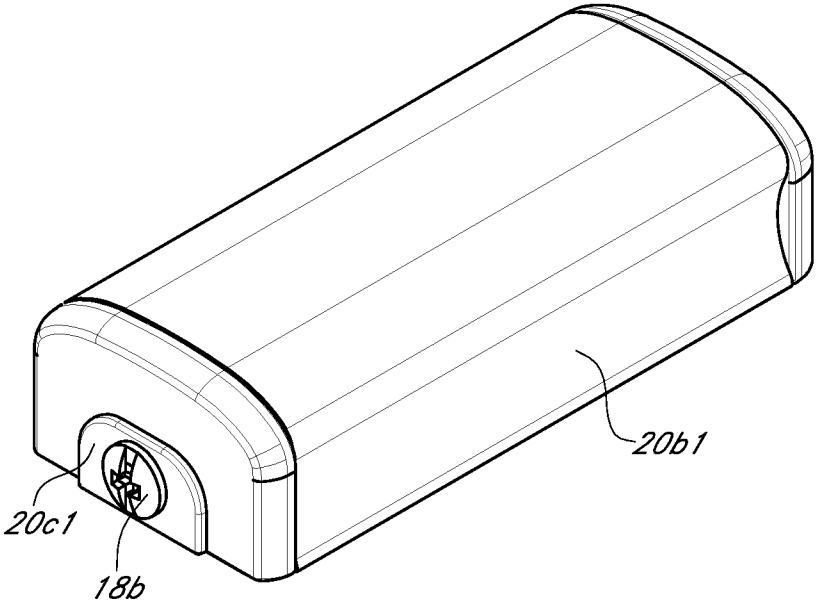
FIG. 2 is a top-perspective view of a handle member of the handle assembly of FIG. 1.

Turning to FIG. 2, depicted therein is a top-perspective view of bar member 20 of handle assembly 10. Depicted implementation of bar member 20 is shown to include elongated groove portion 20*b*1, and raised portion 20*c*1.

Figure 3:
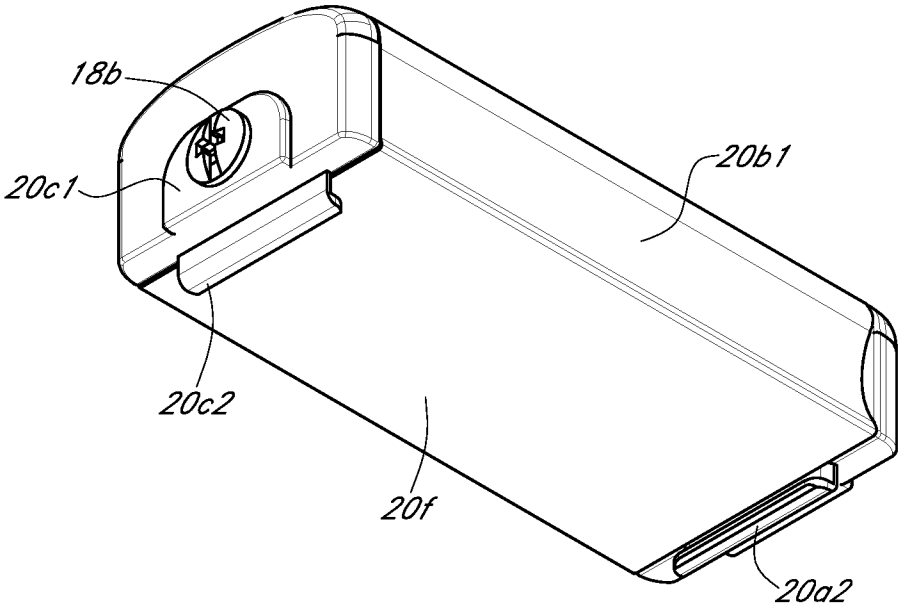
FIG. 3 is a bottom-perspective view of the handle member of FIG. 2.

Turning to FIG. 3, depicted therein is a bottom-perspective view of bar member Depicted implementation of bar member 20 is shown to include clip portion 20*a*2, clip portion 20*c*2, and elongated bottom portion 20*f*. As shown, elongated side portion 20*b*, and elongated side portion 20*d* extend between elongated top portion 20*e* and elongated bottom portion 20*f*. As shown, clip portion 20*a*2 and clip portion 20*c*2 extend away from elongated bottom portion 20*f*.

Figure 4:
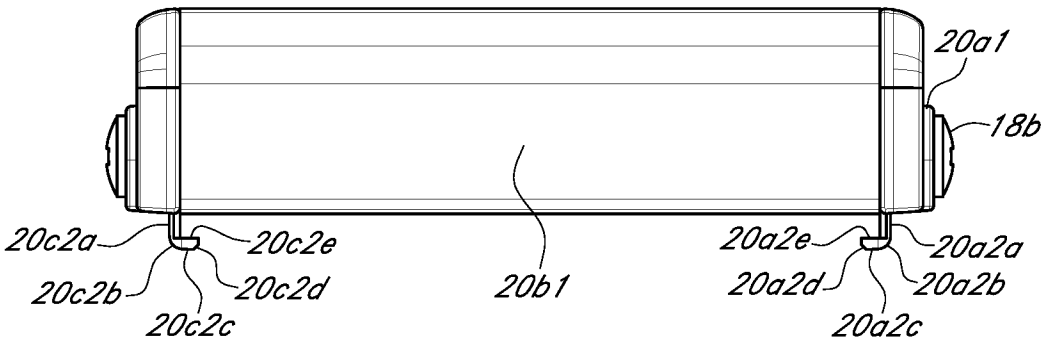
FIG. 4 is a side-elevational view of the handle member of FIG. 2.

Turning to FIG. 4, depicted therein is a side-elevational view of bar member 20. Depicted implementation of bar member 20 is shown to include raised portion 20*a*1, and clip portion 20*a*2 includes leg portion 20*a*2*a*, corner 20*a*2*b*, lower surface 20*a*2*c*, and tapered portion 20*a*2*d*, and inner portion 20*a*2*e* that are shown to be in an L-shape. Depicted implementation of clip portion 20*c*2 of bar member 20 is shown to include leg portion corner 20*c*2*b*, lower surface 20*c*2*c*, tapered portion 20*c*2*d*, and inner portion 20*c*2*e*.

Figure 5:
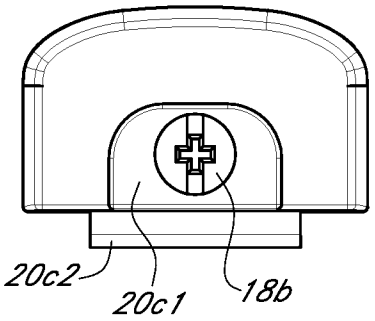
FIG. 5 is an end-elevational view of the handle member of FIG. 2.

Turning to FIG. 5, depicted therein is an end-elevational view of bar member 20.

Figure 6:
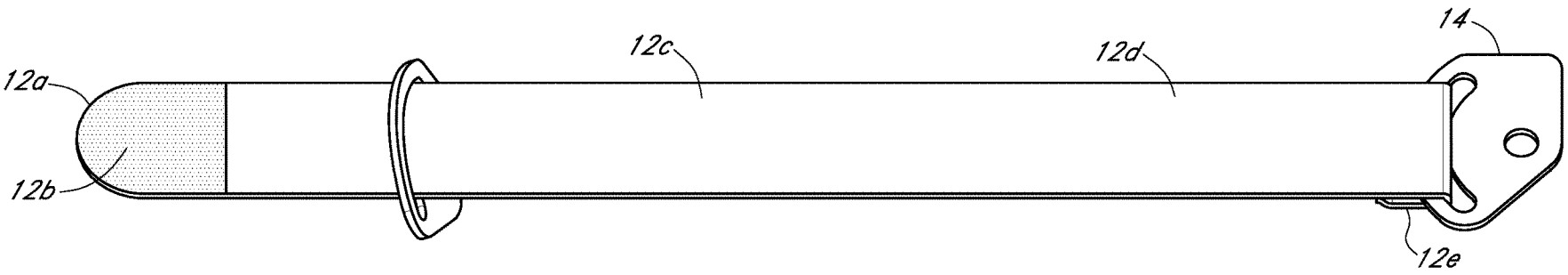
FIG. 6 is a perspective view of a portion of the strap assembly being coupled with a bracket assembly of the handle assembly of FIG. 1.

Turning to FIG. 6, depicted therein is a perspective view of a portion of elongated strap assembly 12 coupled with bracket assembly 14.

Figure 7:
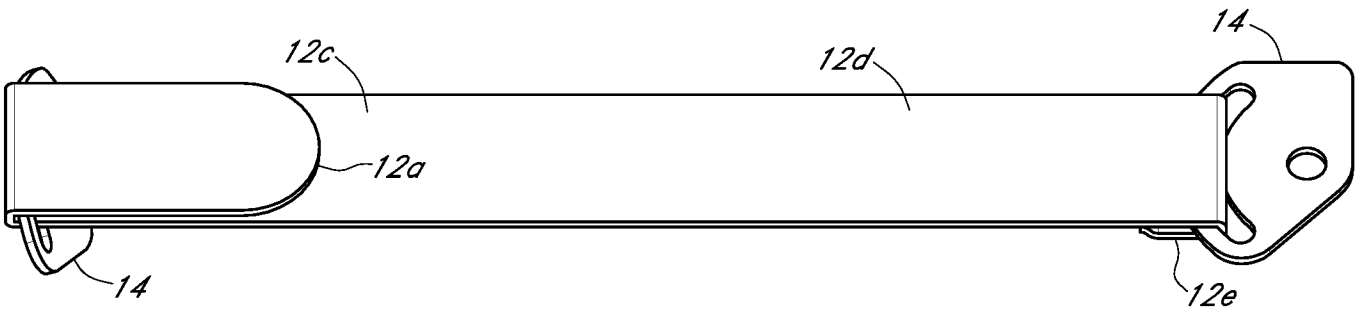
FIG. 7 is a plan view of a portion of the strap assembly of FIG. 6 coupled with the bracket assembly of FIG. 6.

Turning to FIG. 7, depicted therein is a plan view of a portion of elongated strap assembly 12 coupled with bracket assembly 14.

Figure 8:
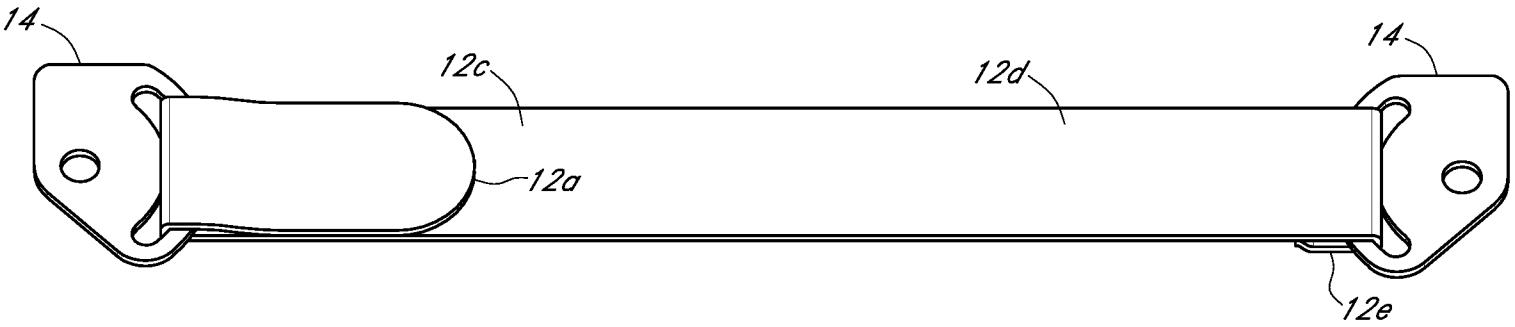
FIG. 8 is a plan view of the strap assembly coupled with the bracket assembly of FIG. 6.

Turning to FIG. 8, depicted therein is a plan view of elongated strap assembly 12 coupled with bracket assembly 14.

Figure 9:
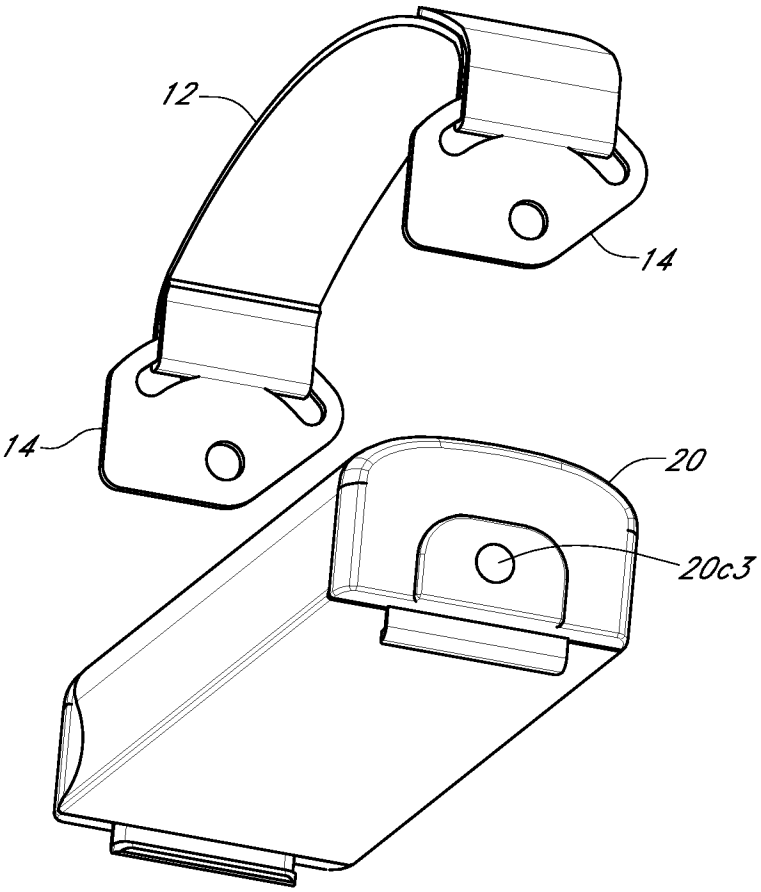
FIG. 9 is a perspective view of portions of the handle member of FIG. 2 and the strap assembly coupled with the bracket assembly of FIG. 6.

Turning to FIG. 9, depicted therein is a perspective view of portions of bar member 20 and elongated strap assembly 12 coupled with bracket assembly 14. Depicted implementation of bar member 20 is shown to include aperture 20*c*3.

Figure 10:
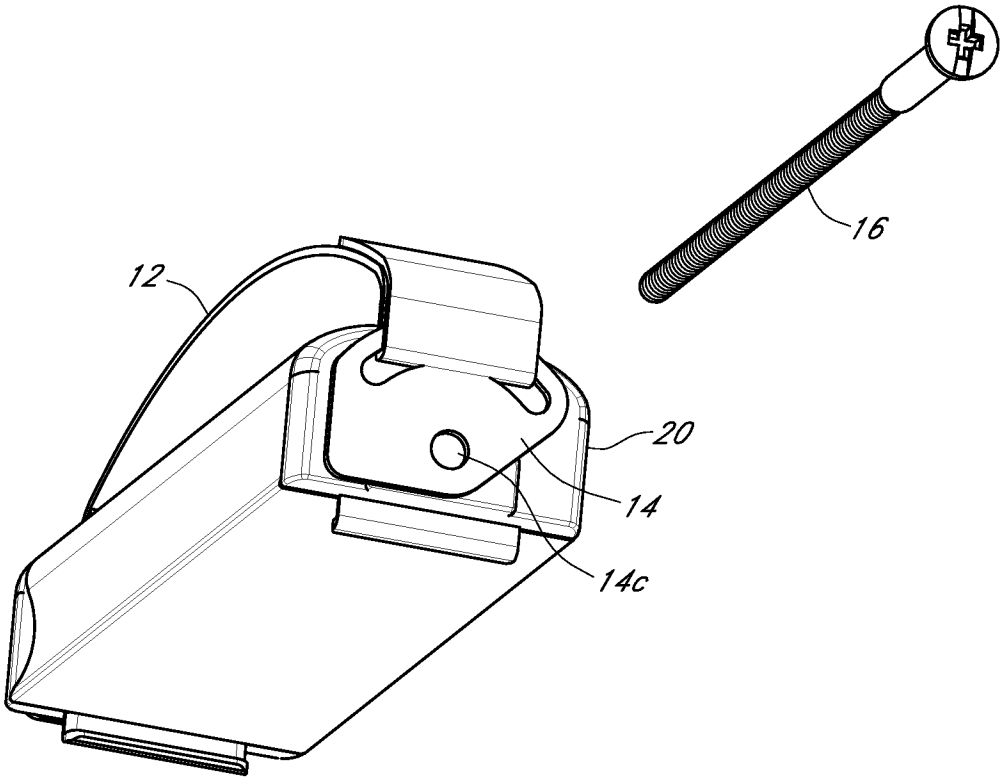
FIG. 10 is a perspective view of portions of the handle member of FIG. 2, the strap assembly coupled with the bracket assembly of FIG. 6, and a pin member of FIG. 1.

Turning to FIG. 10, depicted therein is a perspective view of portions of bar member 20, elongated strap assembly 12 coupled with bracket assembly 14, and pin member 16.

Figure 11:
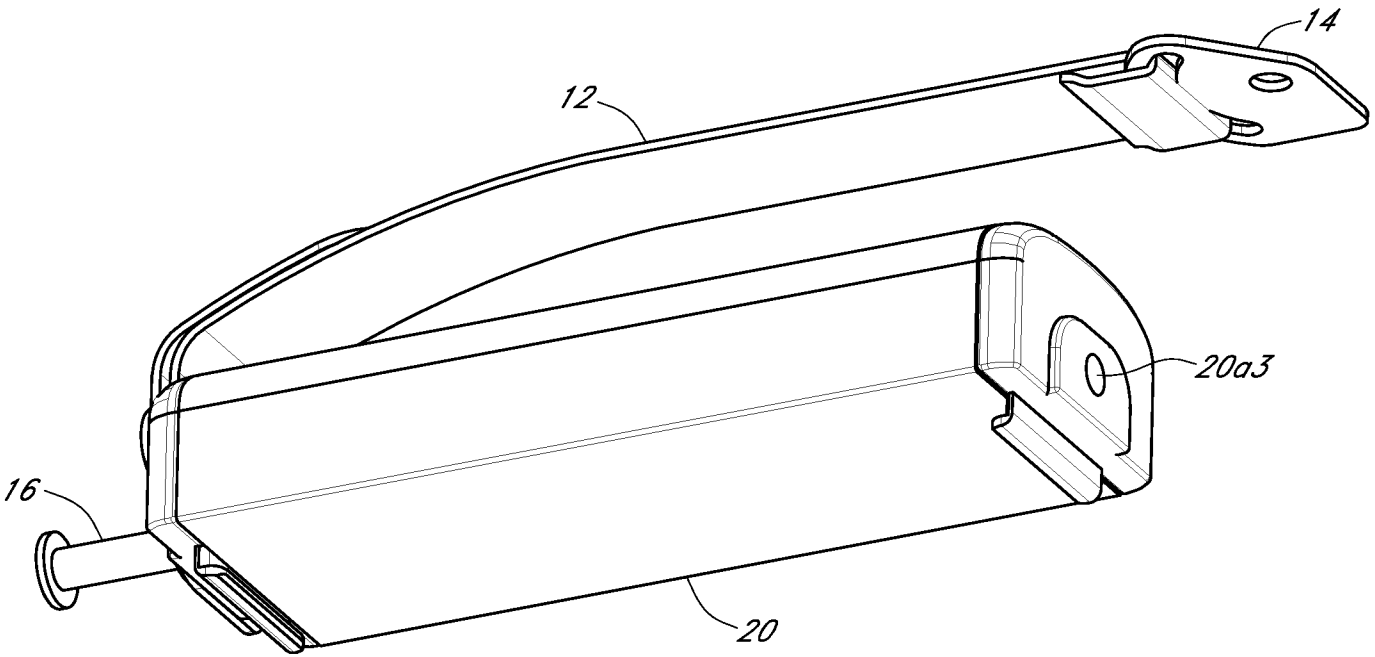
FIG. 11 is a perspective view of portions of the handle member of FIG. 2, the strap assembly coupled with the bracket assembly of FIG. 6, and the pin member of FIG. 1.

Turning to FIG. 11, depicted therein is a perspective view of portions of bar member 20, elongated strap assembly 12 coupled with bracket assembly 14, and pin member 16. Depicted implementation of bar member 20 is shown to include aperture 20*a*3.

Figure 12:
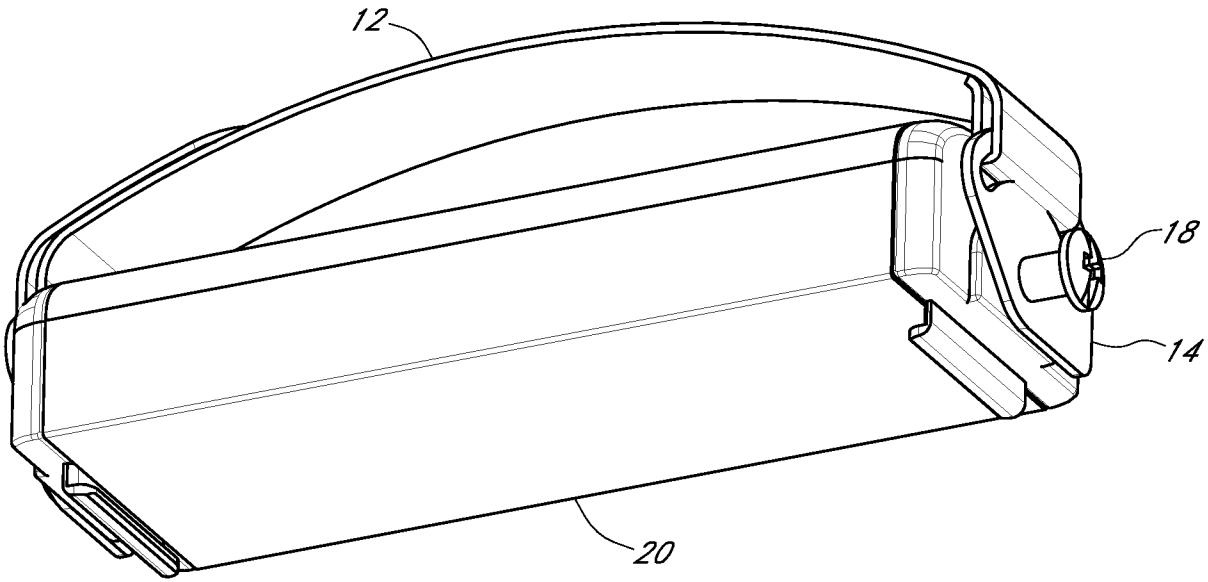
FIG. 12 is a side-perspective view of portions of the handle member of FIG. 2, the strap assembly coupled with the bracket assembly of FIG. 6, and the pin member of FIG. 1.

Turning to FIG. 12, depicted therein is a side-perspective view of portions of bar member 20, elongated strap assembly 12 coupled with bracket assembly 14, and pin member 16.

Figure 13:
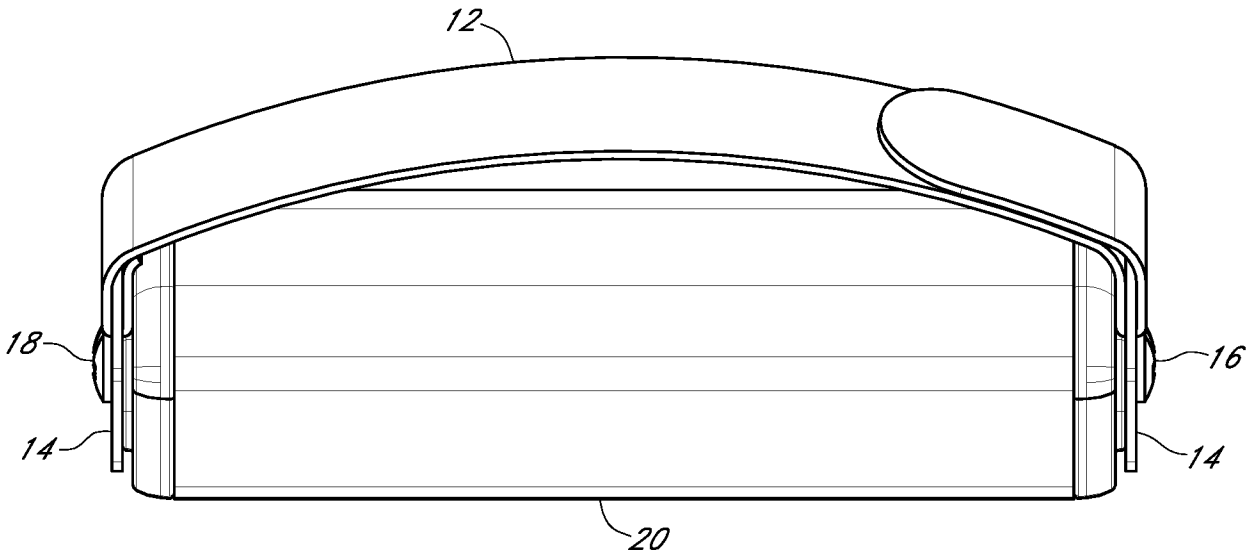
FIG. 13 is a top-perspective view of portions of the handle member of FIG. 2, the strap assembly coupled with the bracket assembly of FIG. 6, and the pin member of FIG. 1.

Turning to FIG. 13, depicted therein is a top-perspective view of portions of bar member 20, elongated strap assembly 12 coupled with bracket assembly 14, and pin member 16.

Figure 14:
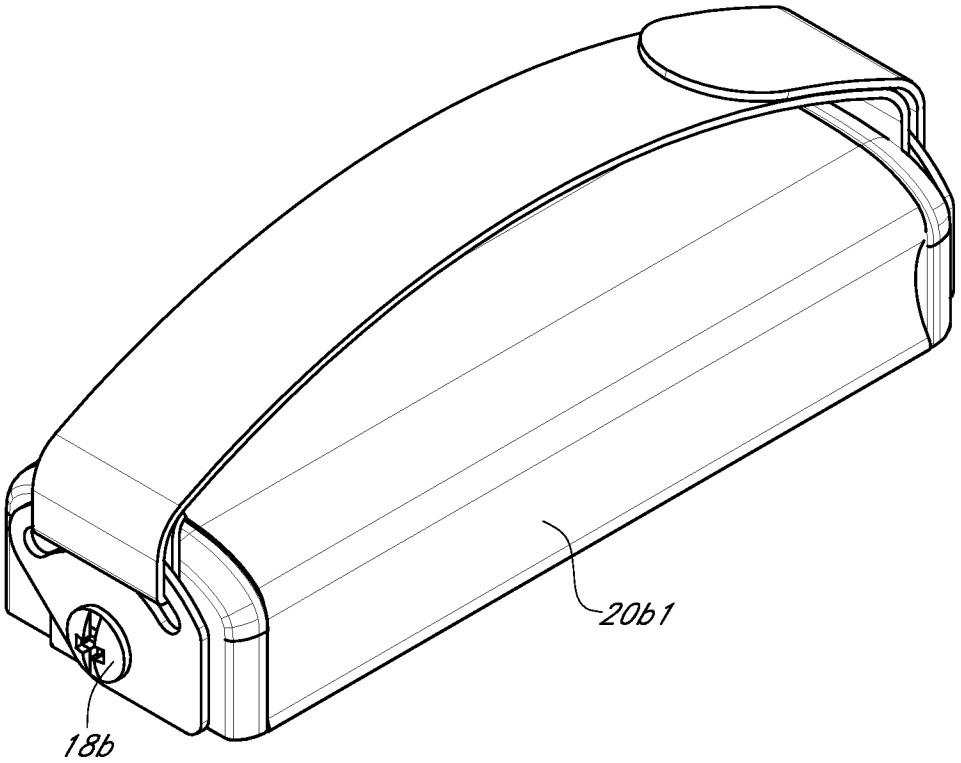
FIG. 14 is a top-perspective view of the handle assembly of FIG. 1.
Figure 15:
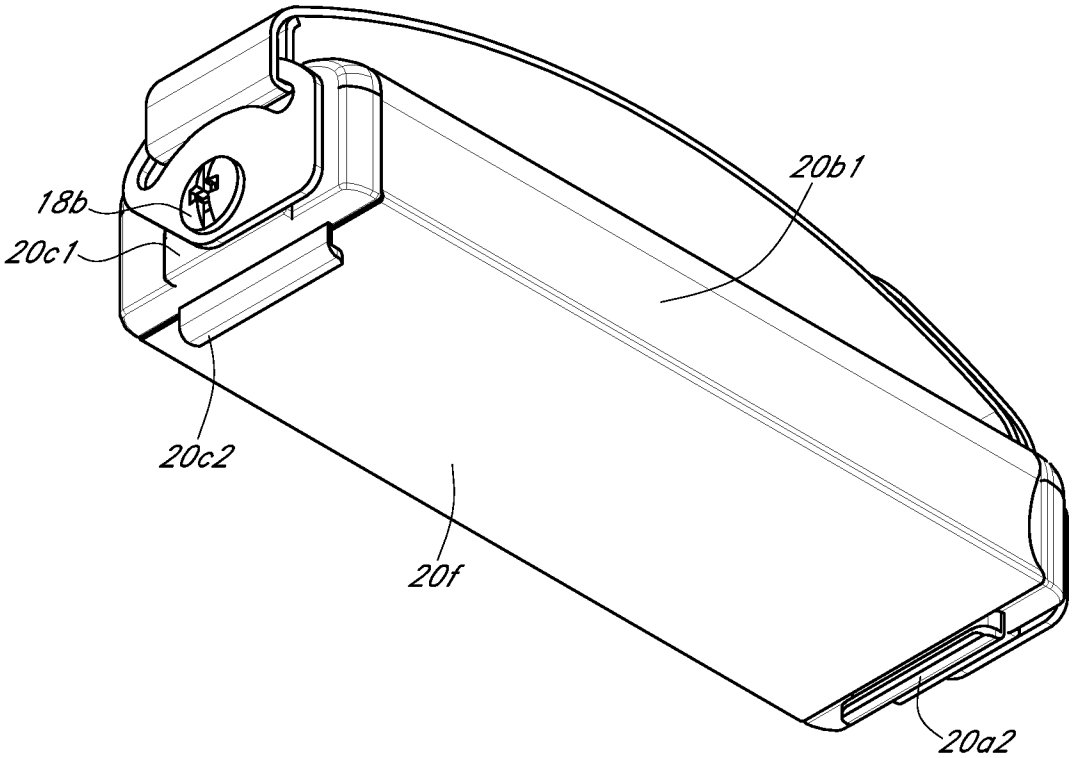
FIG. 15 is a bottom-perspective view of the handle assembly of FIG. 1.

Turning to FIG. 14, depicted therein is a top-perspective view of handle assembly Turning to FIG. 15, depicted therein is a bottom-perspective view of handle assembly 10.

Figure 16:
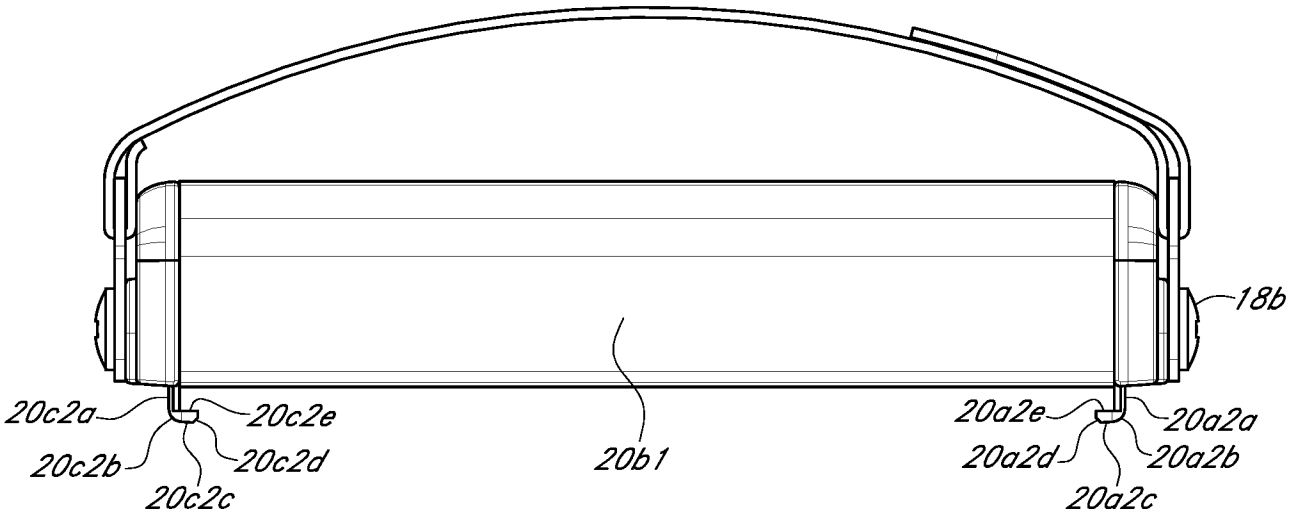
FIG. 16 is a side-elevational view of the handle assembly of FIG. 1.
Figure 17:
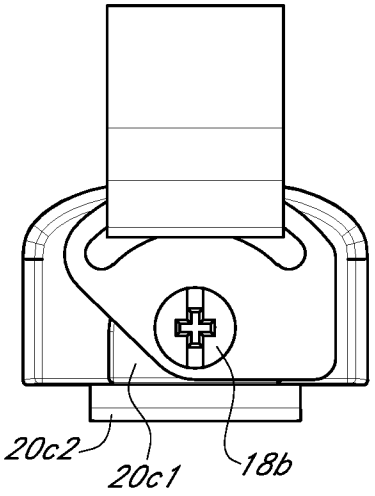
FIG. 17 is a end-elevational view of the handle assembly of FIG. 1.
Figure 18:
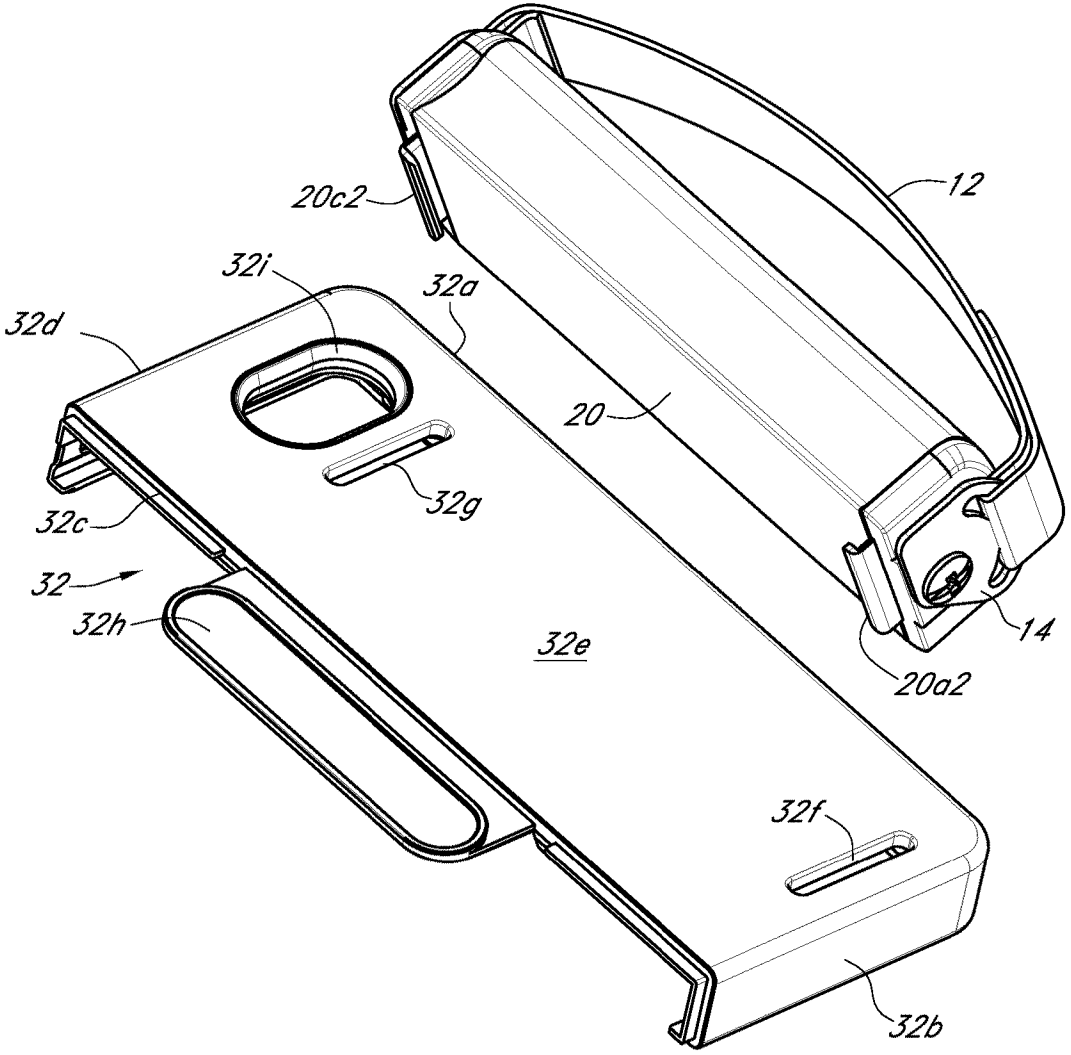
FIG. 18 is a perspective view of a cap assembly and the handle assembly of FIG. 1.

Turning to FIG. 16, depicted therein is a side-elevational view of handle assembly Turning to FIG. 17, depicted therein is a end-elevational view of handle assembly Turning to FIG. 18, depicted therein is a perspective view of cap assembly 32 and handle assembly 10. Depicted implementation of cap assembly 32 is shown to include side wall 32*a*, side wall 32*b*, side edge 32*c*, side wall 32*d*, base 32*e*, elongated aperture 32*f* (shaped, sized, and positioned to couple with clip portion 20*c*2), elongated aperture 32*g* (shaped, sized, and positioned to couple with clip portion 20*a*2), tab member 32*h*, and lens portion 32*i*. As depicted, tab member 32*h* extends away from side edge 32*c* and extends away from side wall 32*a* as well.

Figure 19:
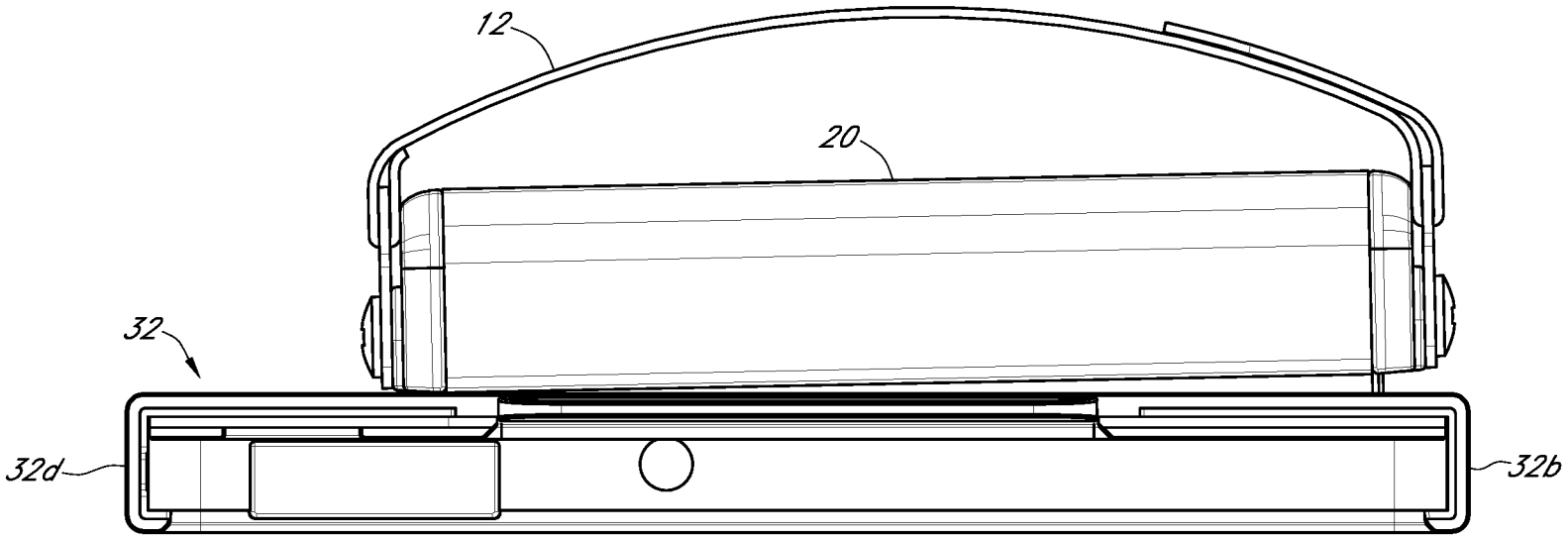
FIG. 19 is a perspective view of the cap assembly of FIG. 18 and the handle assembly of FIG. 1.

Turning to FIG. 19, depicted therein is a perspective view of cap assembly 32 and the handle assembly of FIG. 1.

Figure 20:
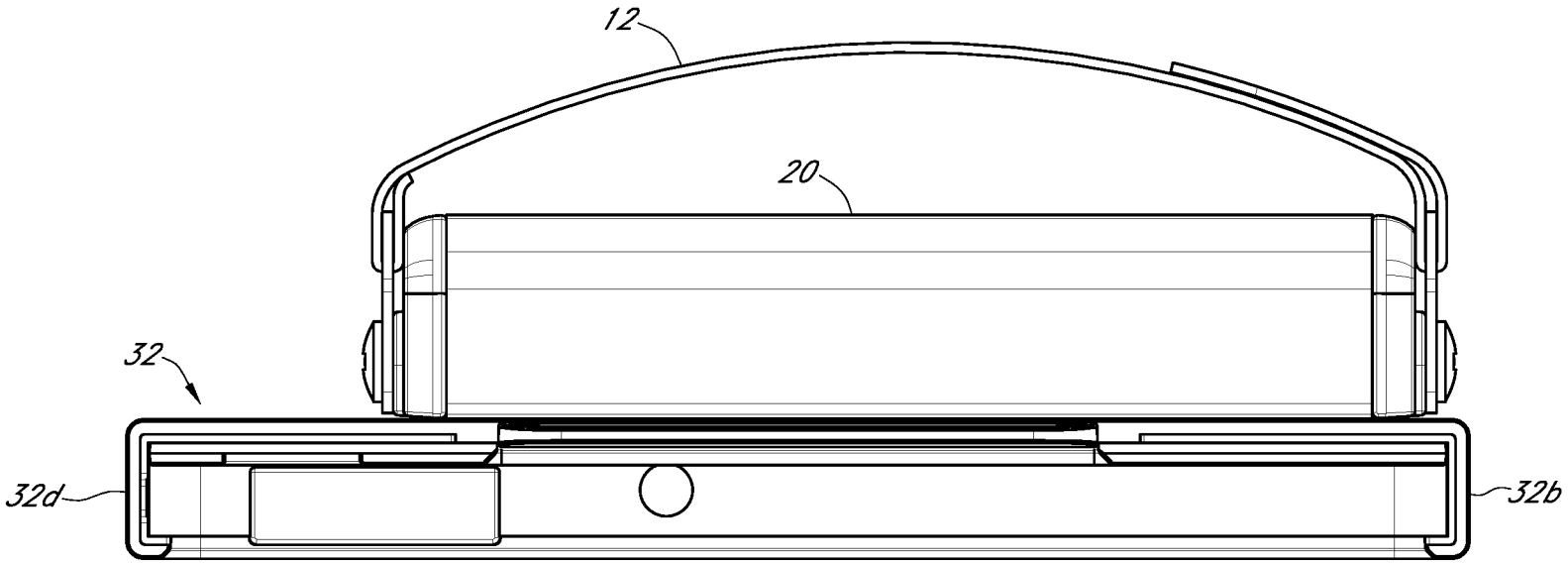
FIG. 20 is a perspective view of the cap assembly of FIG. 18 and the handle assembly of FIG. 1 coupled together.

Turning to FIG. 20, depicted therein is a perspective view of bar member 20 and the handle assembly 10 coupled together. In implementations, wherein elongated top portion is positioned at least one half inch from the cap assembly 32 when bar member 20 is coupled with the device case assembly.

Figure 21:
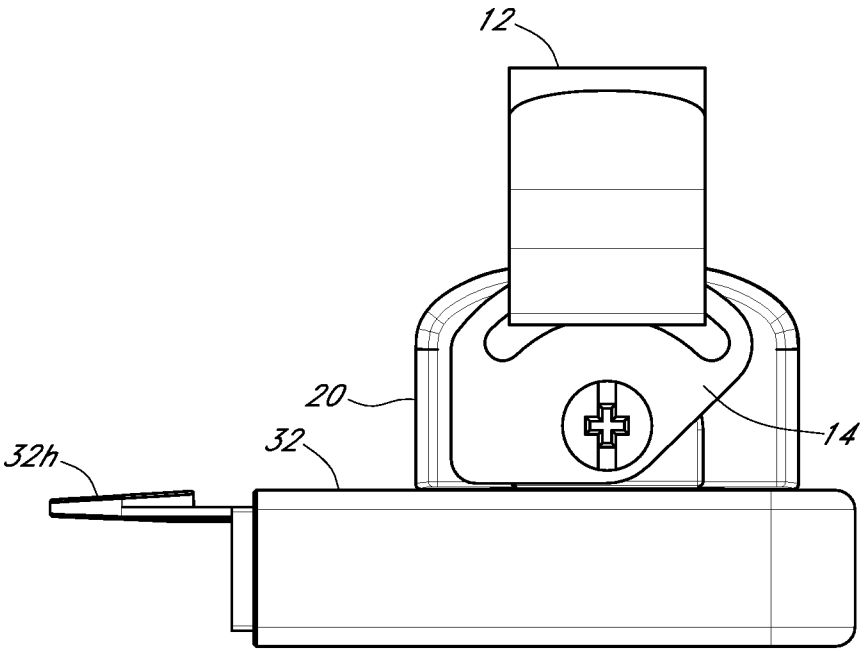
FIG. 21 is an end view of the cap assembly of FIG. 18 and the handle assembly of FIG. 1 coupled together.

Turning to FIG. 21, depicted therein is an end view of cap assembly 32 and handle assembly 10.

Figure 22:
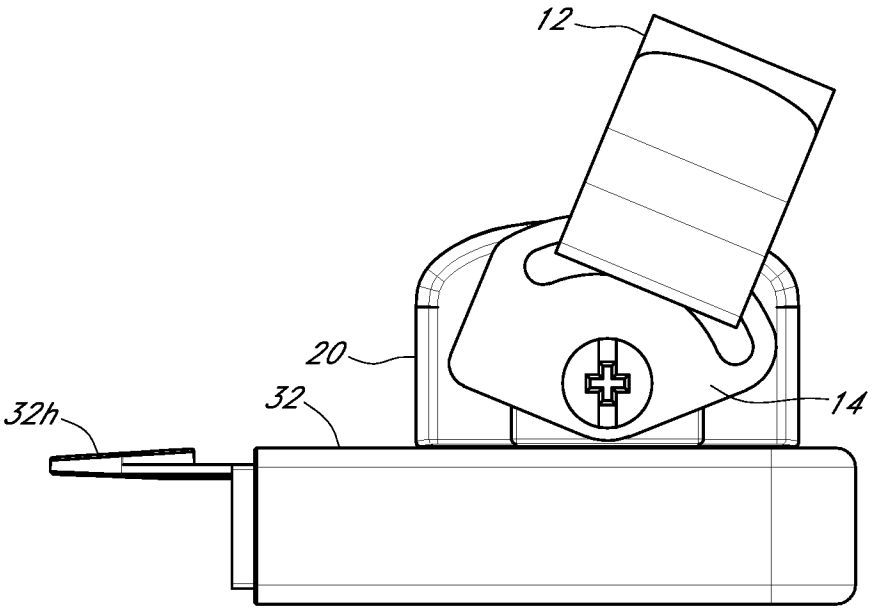
FIG. 22 is an end view of the cap assembly of FIG. 18 and the handle assembly of FIG. 1 coupled together.

Turning to FIG. 22, depicted therein is an end view of cap assembly 32 and handle assembly 10 coupled together.

Figure 23:
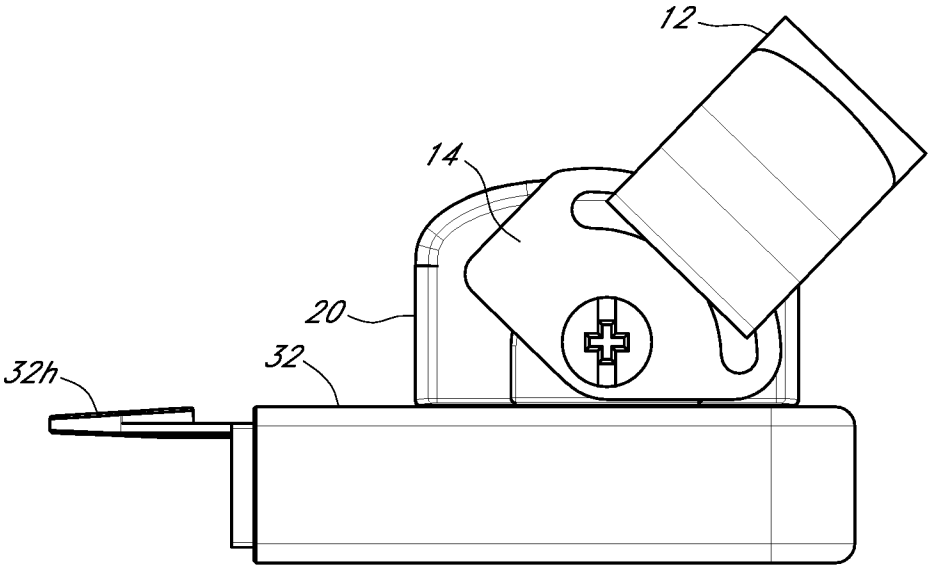
FIG. 23 is an end view of the cap assembly of FIG. 18 and the handle assembly of FIG. 1 coupled together.

Turning to FIG. 23, depicted therein is an end view of cap assembly 32 and handle assembly 10 coupled together.

Figure 24:
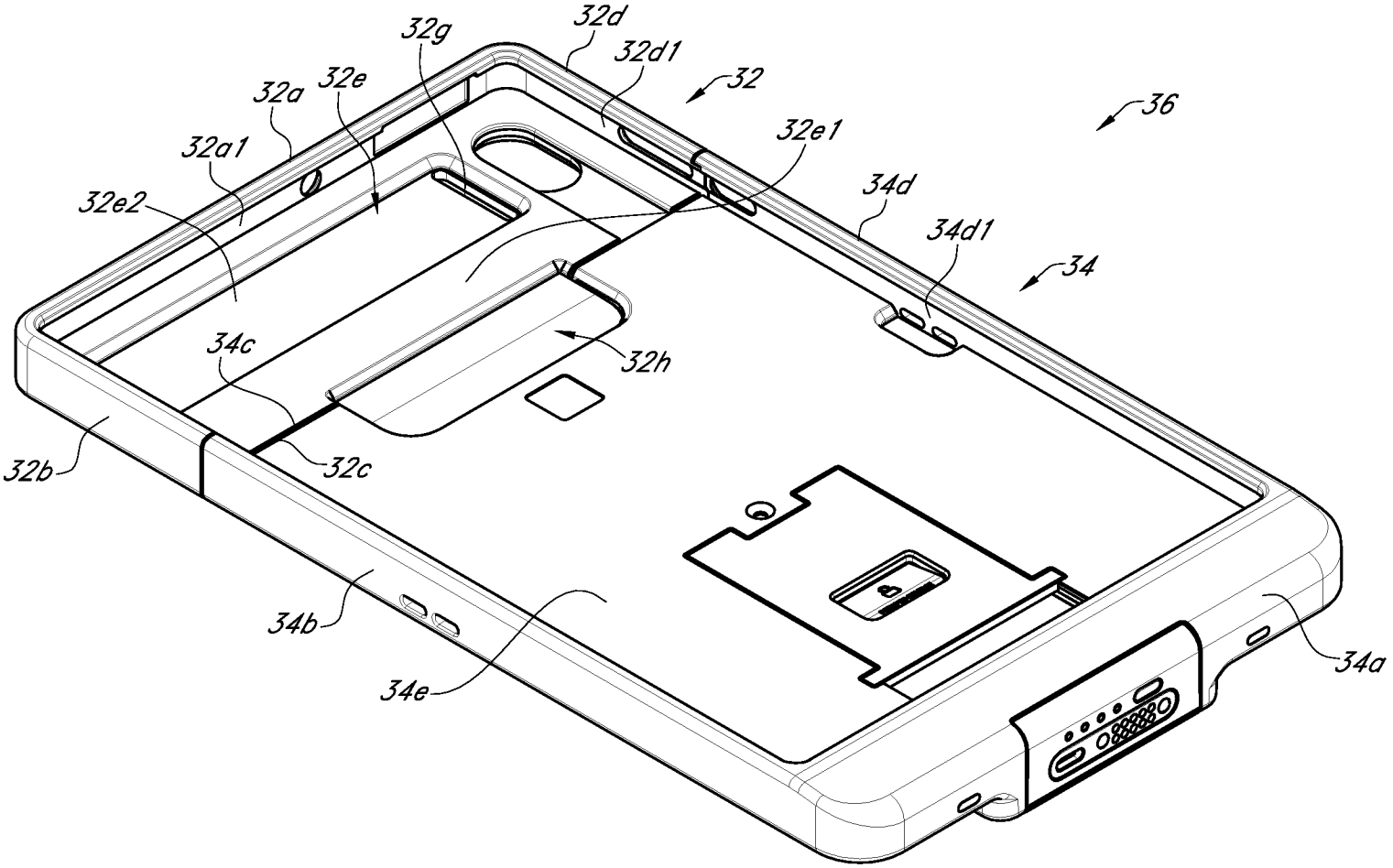
FIG. 24 is a rear-top-perspective view of the cap assembly of FIG. 18 and a main assembly coupled together to form a case assembly.

Turning to FIG. 24, depicted therein is a rear top perspective view of cap assembly 32 and main assembly 34 coupled together to form device case assembly 30.

Depicted implementation of cap assembly 32 is shown to include elongated groove 32*d*1, raised portion 32*e*1, and recessed portion 32*e*2. As depicted, side wall 32*b* and side wall 32*d* extend perpendicular with respect to side wall 32*a*. As depicted, side edge 32*c* extends parallel with respect to side wall 32*a*. As depicted, side edge 32*c* is spaced from side wall 32*a* along side wall 32*b* and side wall 32*d*.

Depicted implementation of main assembly 34 is shown to include side wall 34*a*, side wall 34*b*, side edge 34*c*, side wall 34*d*, groove 34*d*1, and base 34*e*. As depicted, side wall 34*b* and side wall 34*d* extend perpendicular with respect to side wall 34*a*. As depicted, side edge 34*c* extends parallel with respect to side wall 34*a*. As depicted, when cap assembly 32, and cap assembly 32, are coupled together, side wall 32*a*, side wall 32*b*, side wall 32*d*, and base 32*e* of cap assembly 32, and side wall 34*a*, side wall 34*b*, side wall 32*d*, and base 34*e* of main assembly 34 form an interior area to couple with portable electronic device 100 (shown in FIG. 30).

Figure 25:
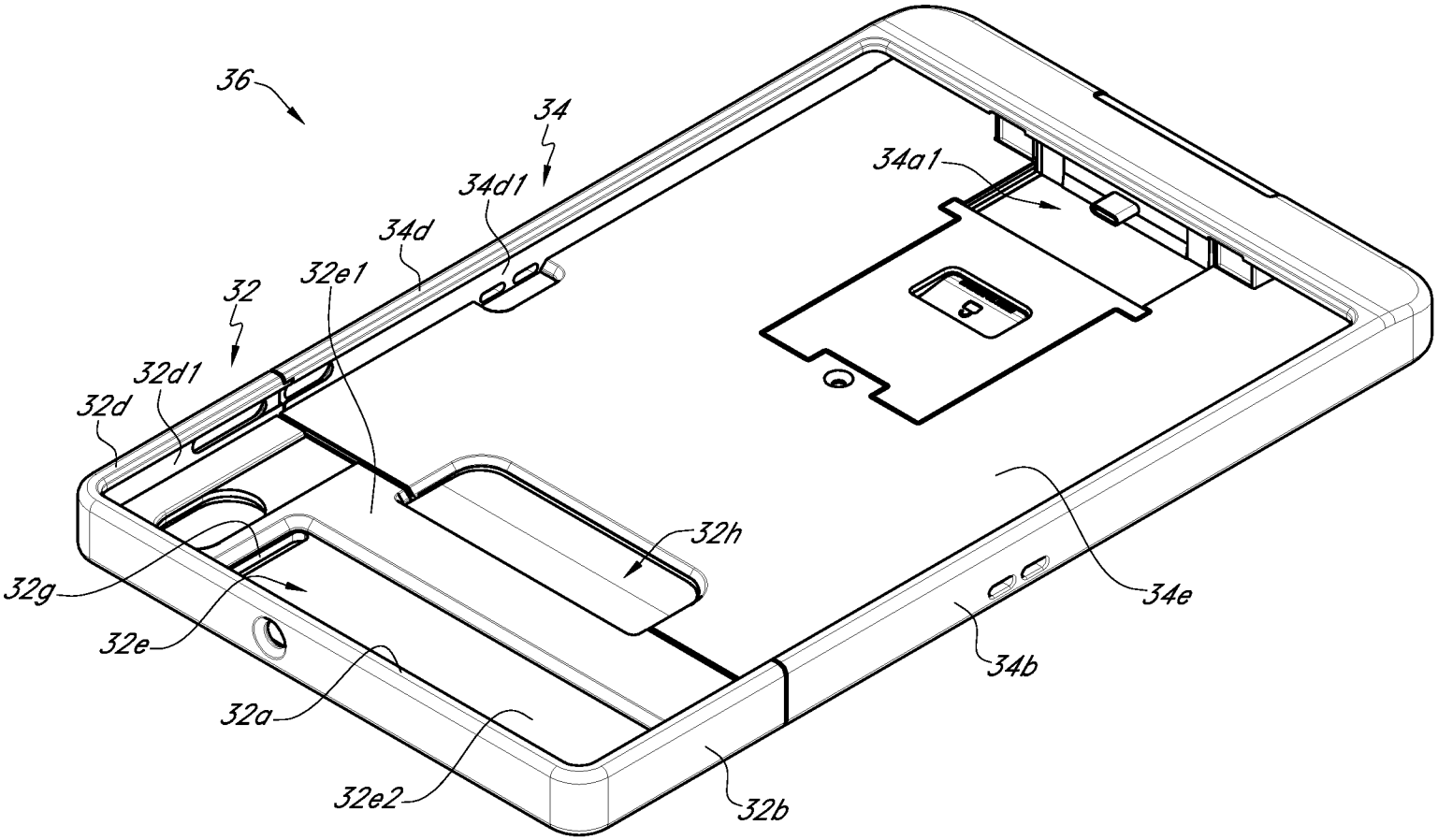
FIG. 25 is a front-top-perspective view of the case assembly of FIG. 24.

Turning to FIG. 25, depicted therein is a front-top-perspective view of device case assembly 30. Depicted implementation of main assembly 34 is shown to include portable electric interface 34*a*1.

Figure 26:
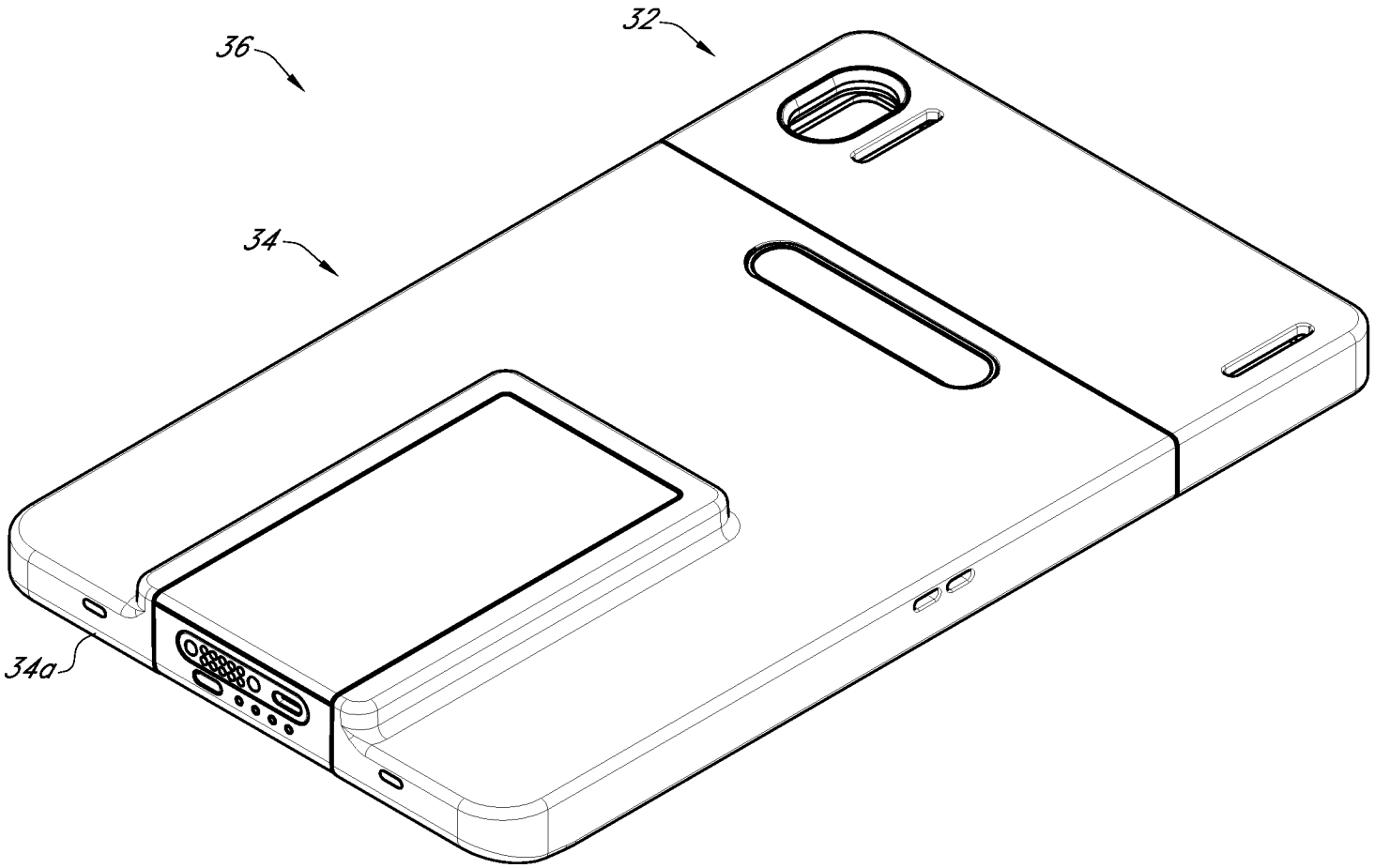
FIG. 26 is a rear-bottom-perspective view of the case assembly of FIG. 24.

Turning to FIG. 26, depicted therein is a rear-bottom-perspective view of device case assembly 30.

Figure 27:
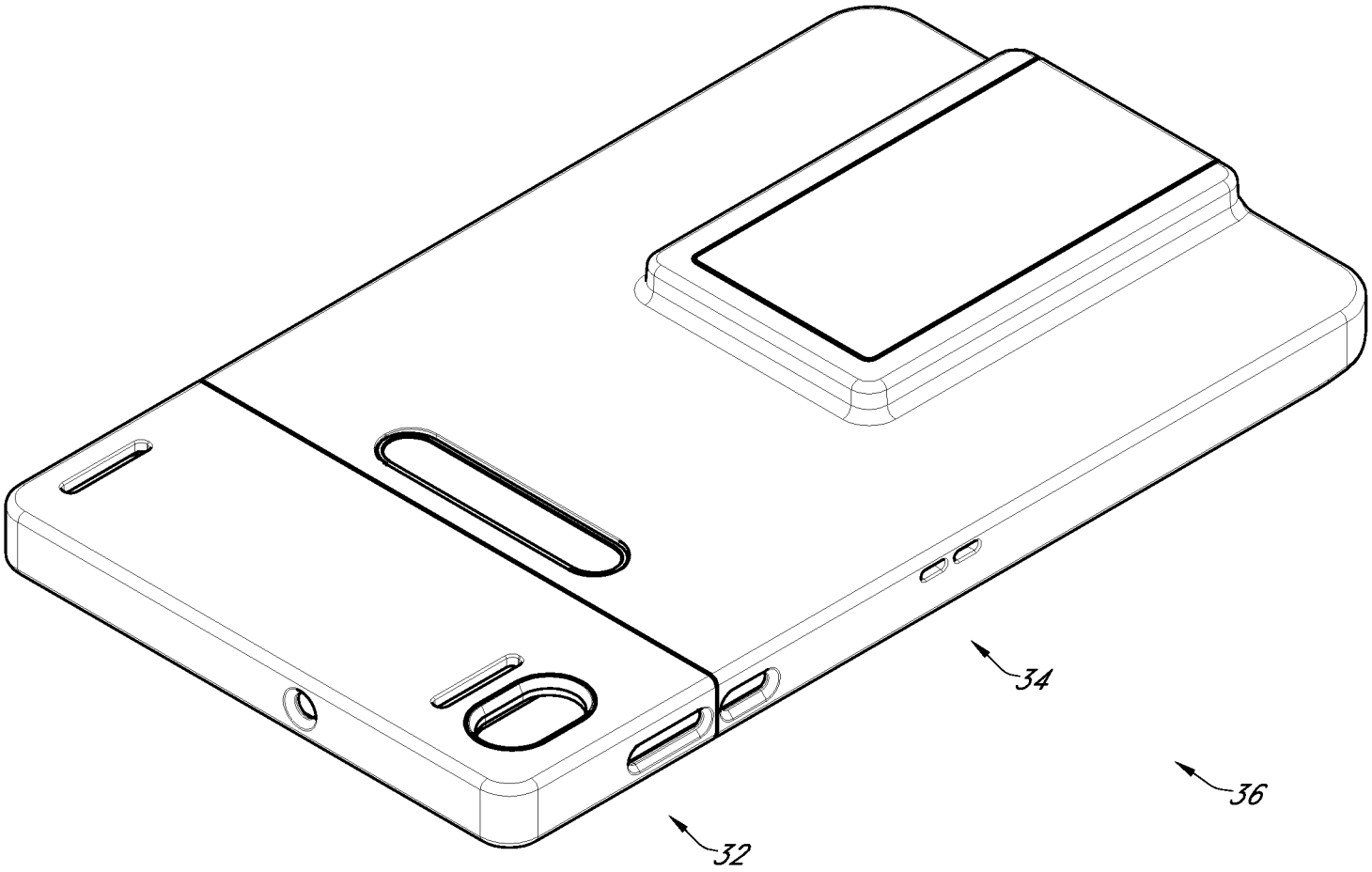
FIG. 27 is a front-bottom-perspective view of the case assembly of FIG. 24.

Turning to FIG. 27, depicted therein is a front-bottom-perspective view of device case assembly 30.

Figure 28:
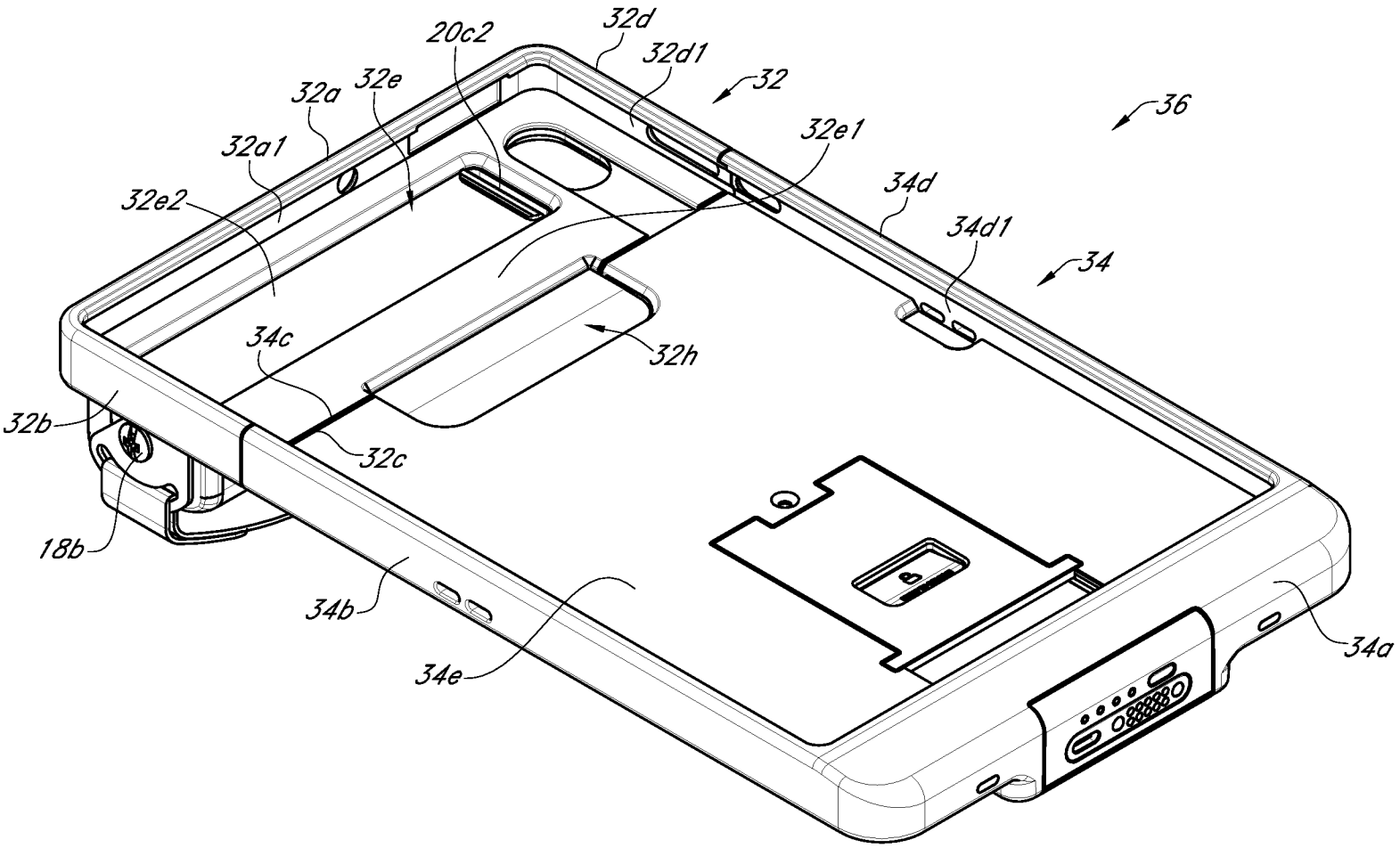
FIG. 28 is a rear-top-perspective view of the case assembly of FIG. 24 coupled with the handle assembly of FIG. 1.
Figure 29:
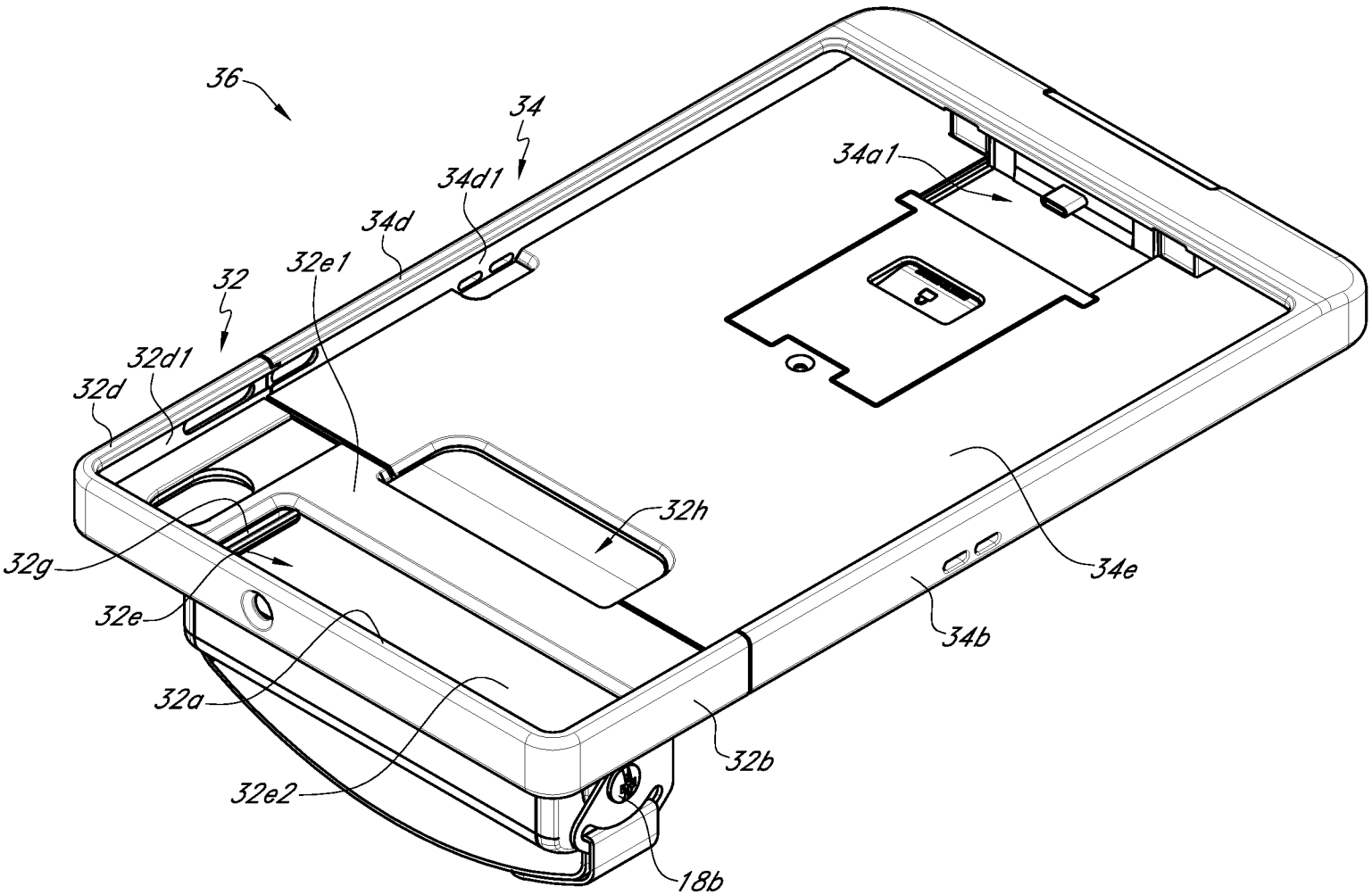
FIG. 29 is a front-top-perspective view of the case assembly of FIG. 24 coupled with the handle assembly of FIG. 1.

Turning to FIG. 28, depicted therein is a rear-top-perspective view of device case assembly 30 coupled with handle assembly 10. As depicted, Turning to FIG. 29, depicted therein is a front-top-perspective view of device case assembly 30 coupled with device case assembly 30.

Figure 30:
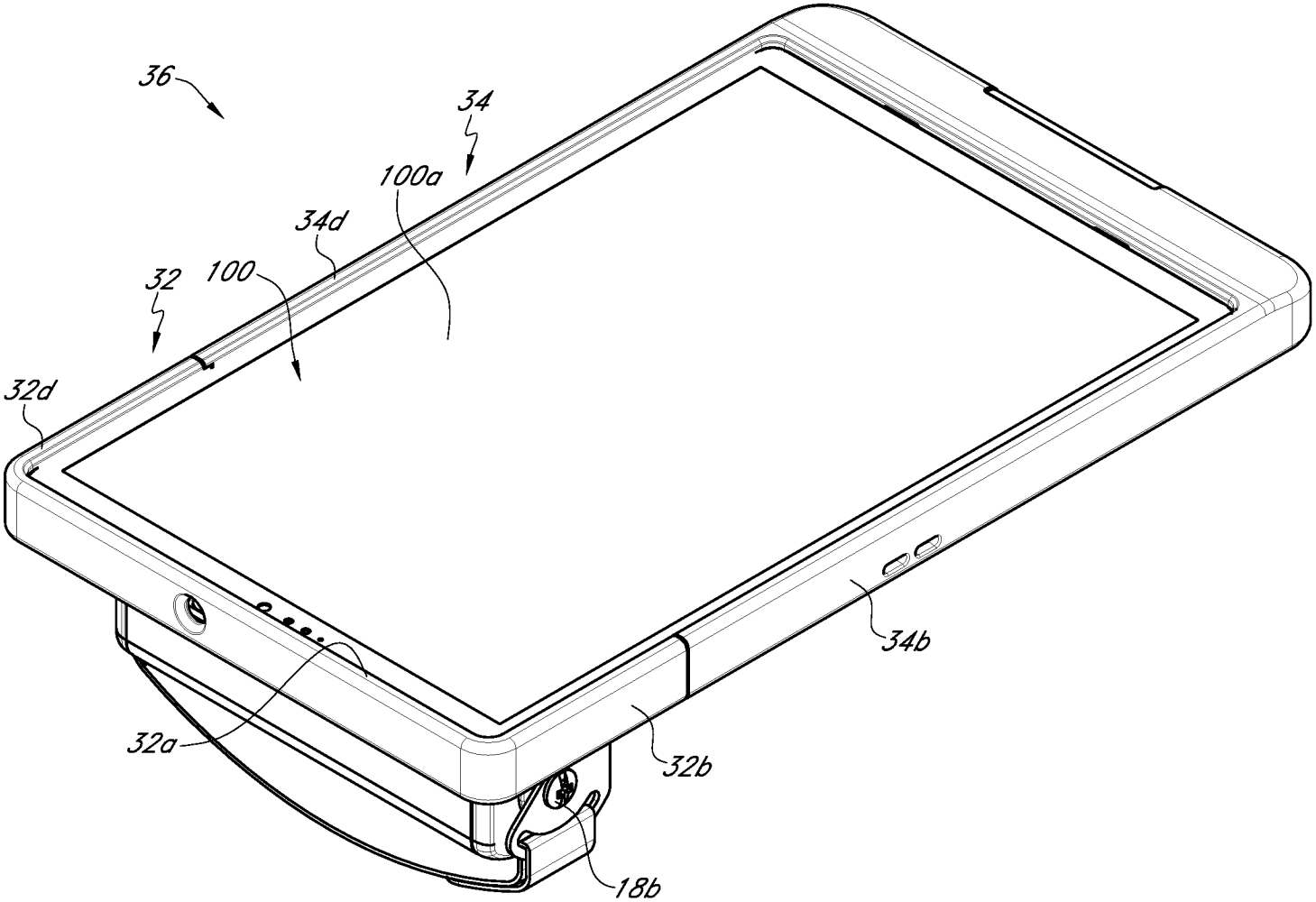
FIG. 30 is a front-top-perspective view of the case assembly of FIG. 24 coupled with the handle assembly of FIG. 1 and coupled with an electronic device.

Turning to FIG. 30, depicted therein is a front-top-perspective view of device case assembly 30 coupled with handle assembly 10 and coupled with portable electronic device 100. Depicted implementation of portable electronic device 100 is shown to include display 100*a*.

Figure 31:
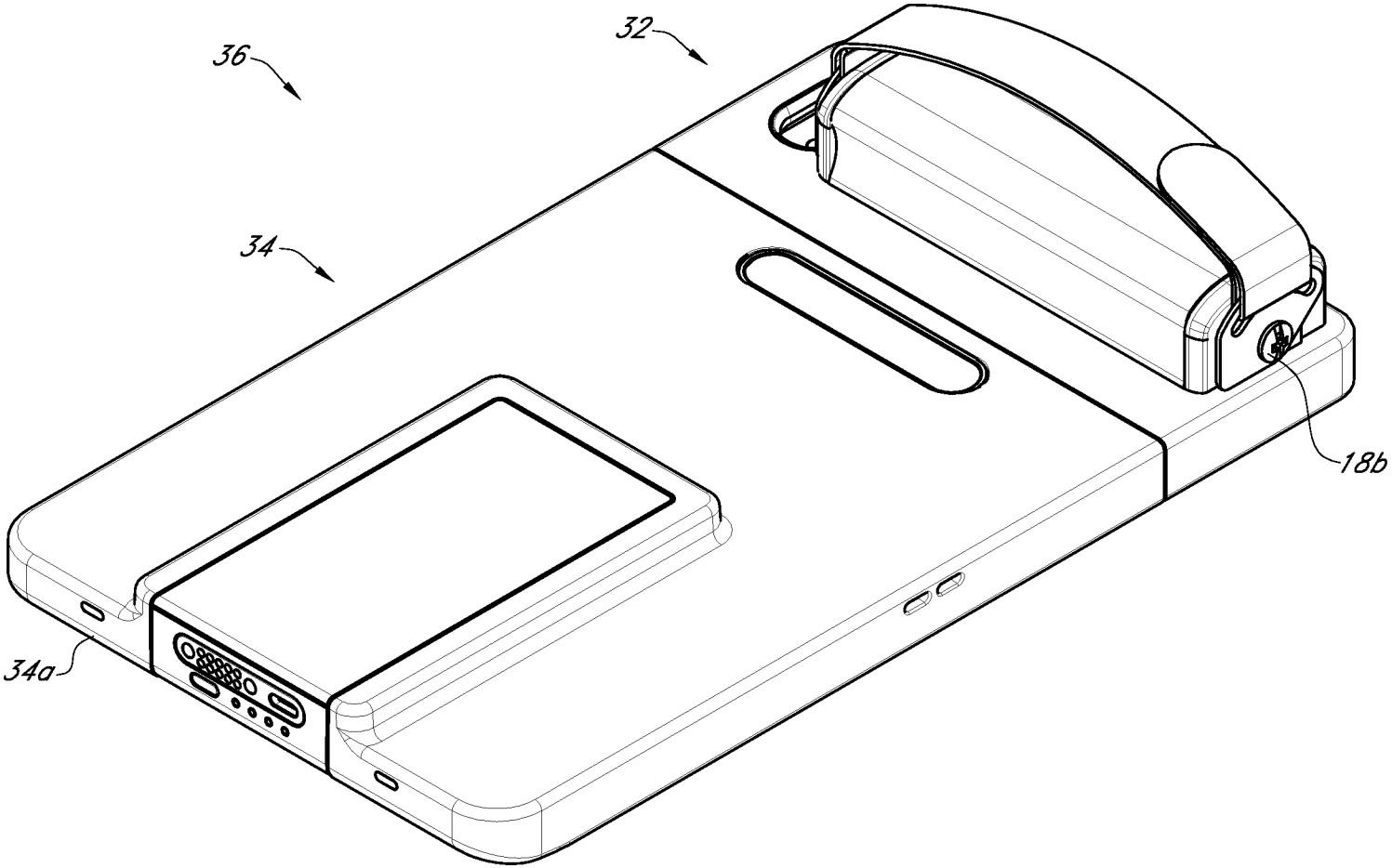
FIG. 31 is a rear-bottom-perspective view of the case assembly of FIG. 24 coupled with the handle assembly of FIG. 1.

Turning to FIG. 31, depicted therein is a rear-bottom-perspective view of device case assembly 30 with handle assembly 10.

Figure 32:
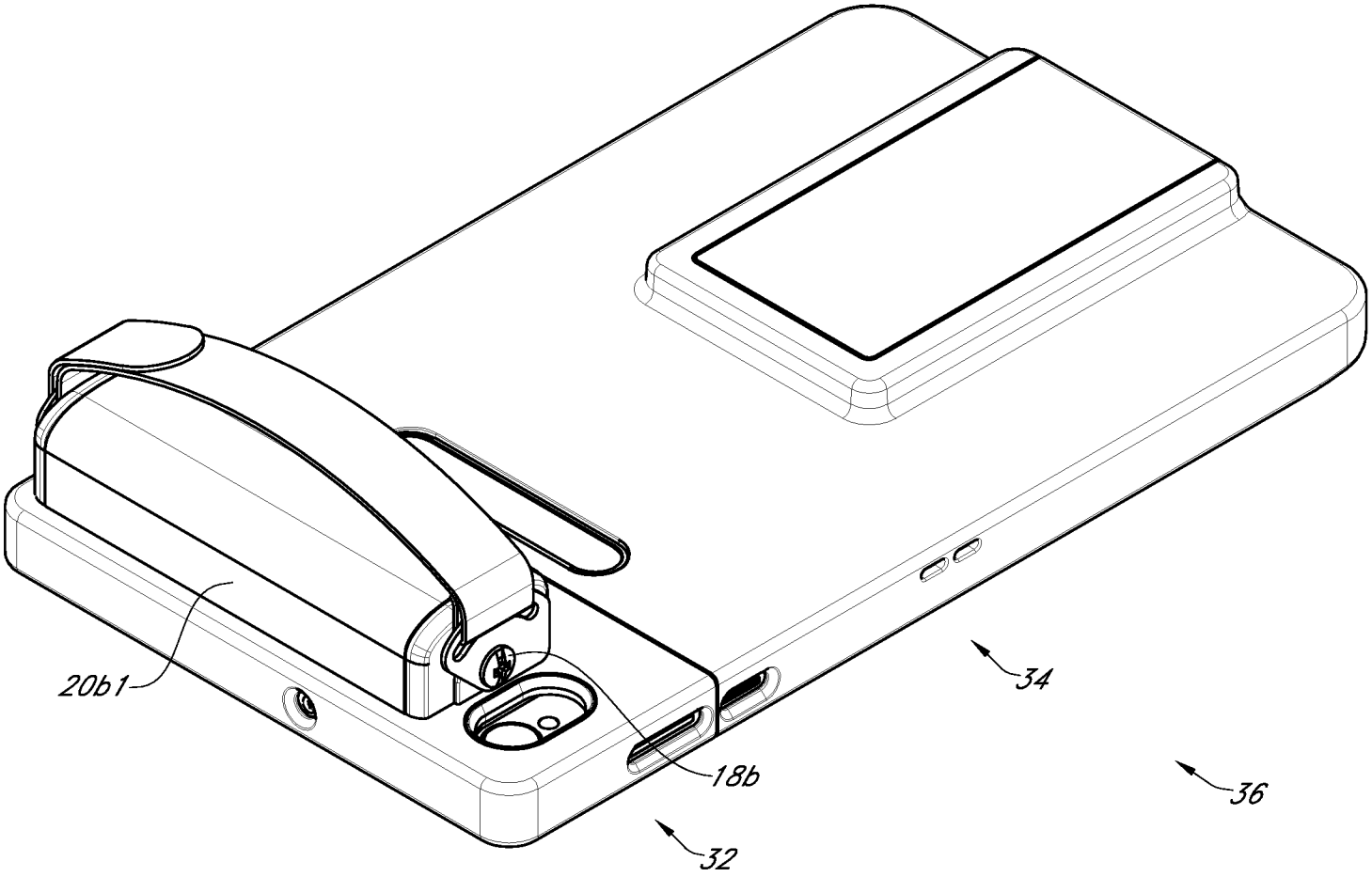
FIG. 32 is a front-bottom-perspective view of the case assembly of FIG. 24 coupled with the handle assembly of FIG. 1.

Turning to FIG. 32, depicted therein is a front-bottom-perspective view of device case assembly 30 coupled with handle assembly 10.

Figure 33:
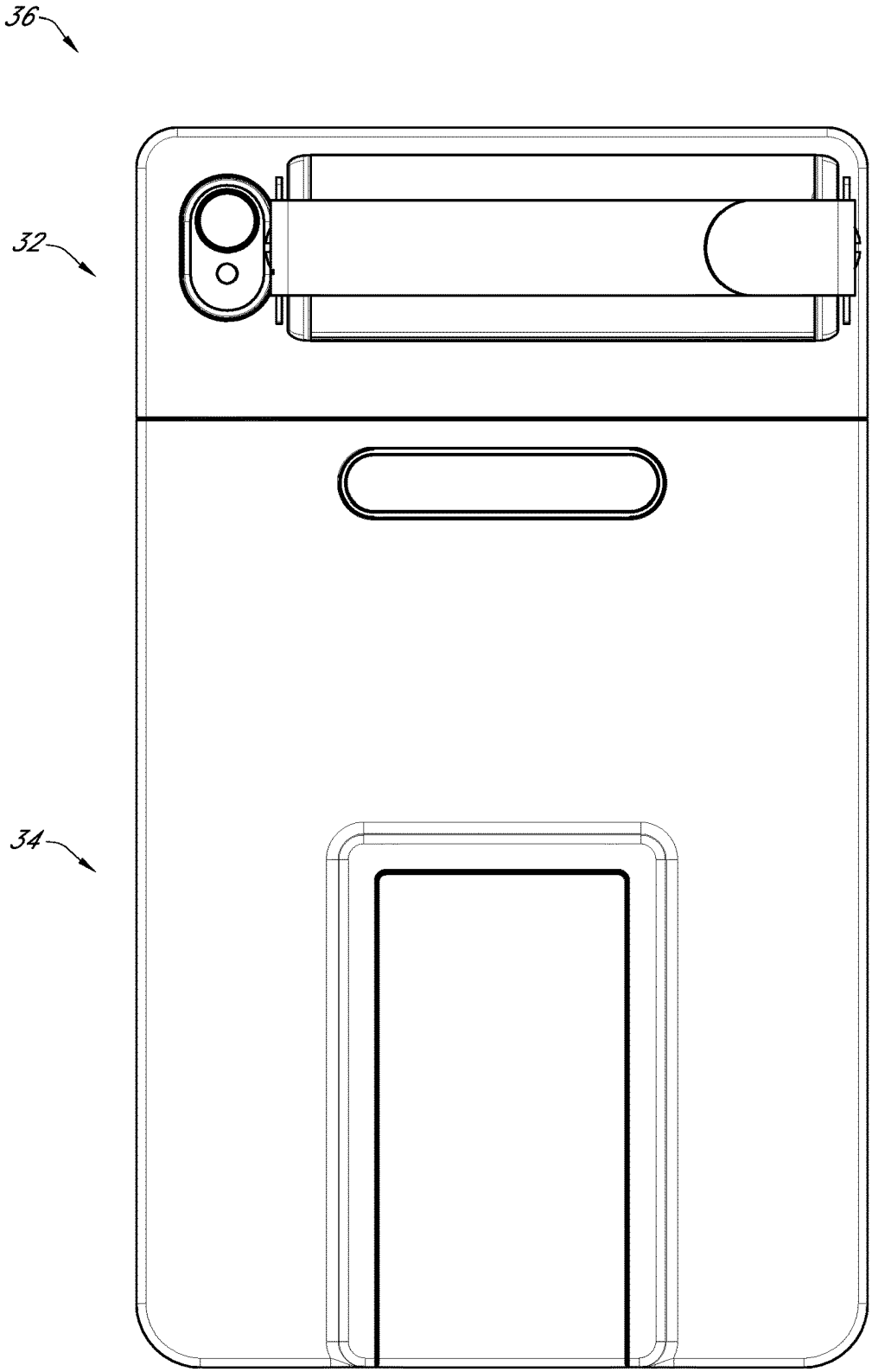
FIG. 33 is a bottom-plan-view of the case assembly of FIG. 24 coupled with the handle assembly of FIG. 1.

Turning to FIG. 33, depicted therein is a bottom-plan-view of device case assembly 30 coupled with handle assembly 10.

Figure 34:
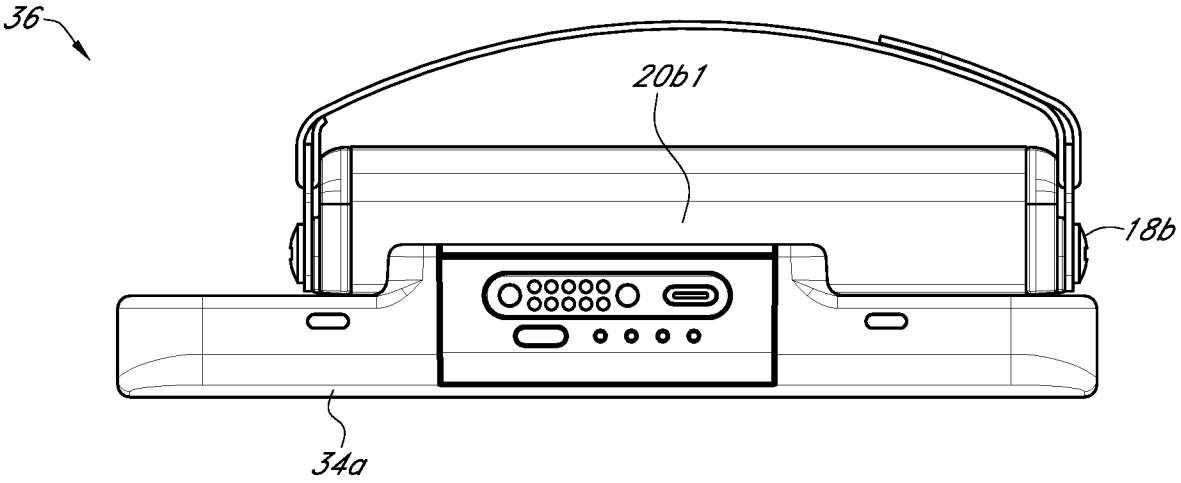
FIG. 34 is a rear-elevational view of the case assembly of FIG. 24 coupled with the handle assembly of FIG. 1.

Turning to FIG. 34, depicted therein is a rear-elevational view of device case assembly 30 coupled with handle assembly 10.

Figure 35:
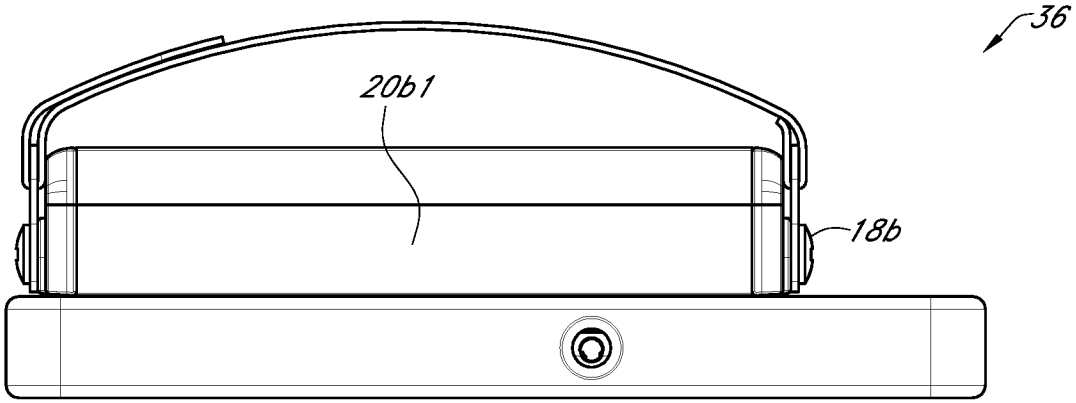
FIG. 35 is a front-elevational view of the case assembly of FIG. 24 coupled with the handle assembly of FIG. 1.

Turning to FIG. 35, depicted therein is a front-elevational view of device case assembly 30 coupled with handle assembly 10.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A system for a portable electronic device comprising:

(I) an elongated bar with a flat surface;

(II) first and second projections perpendicularly extending from the flat surface of the elongated bar; and (III) a device case including a base with oppositely facing interior and exterior surfaces, (a) the interior surface of the base including first and second portions having first and second levels, respectively, with a change in elevation between the first and second levels relative to one another so as the second portion appears sunken with respect to the first portion, (b) the base having first and second apertures extending through the base from the exterior surface of the base through to the second portion of the interior surface of the base, (c) the device case further having four sides perpendicularly extending with respect to the interior surface of the base to define at least in part an interior for containing the portable electronic device, wherein the flat surface of the elongated bar is flush with a portion of the exterior surface of the base of the device case, and wherein the elongated bar is coupled to the base of the device case by portions of the first and second projections extending through the first and second apertures of the base past the second portion of the interior surface of the base without breaching that portion of the interior of the device case defined in part by the first portion of the interior surface of the base of the device case and the four sides of the device case thereby allowing for containment of the portable electronic device by the interior of the device case without obstruction by the first and second projections with the portable electronic device.

2. The system of claim 1 wherein the elongated bar further includes a flat first end surface perpendicular to the flat surface of the elongated bar, wherein the elongated bar further includes a flat second end surface perpendicular to the flat surface of the elongated bar, and wherein the flat first end surface is parallel with the flat second end surface.

3. The system of claim 2 further including a strap, wherein the strap is coupled with the flat first end surface of the elongated bar, and wherein the strap is coupled with the flat second end surface of the elongated bar.

4. The system of claim 1 wherein the elongated bar further includes a height dimension, a width dimension, and a length dimension perpendicularly oriented with one another with the length dimension being greater than the height dimension and the width dimension.

5. The system of claim 4 wherein the flat surface of the elongated bar extends along the length dimension of the elongated bar.

6. The system of claim 4 wherein the elongated bar includes an elongated groove, and wherein the elongated groove extends along the length dimension of the elongated bar.

7. The system of claim 4 wherein the elongated bar further includes a first end surface and a second end surface distanced from one another by the length dimension and perpendicular to the flat surface of the elongated bar.

8. The system of claim 7 further including a strap, wherein the strap is coupled to the first end surface of the elongated bar, and wherein the strap is coupled to the second end surface of the elongated bar.

9. The system of claim 8 further including first and second brackets and first and second pin member portions, wherein the strap is coupled to the first bracket, and wherein the strap is coupled to the second bracket, wherein the first pin member portion is coupled to the first bracket and to the first end surface of the elongated bar, wherein the second pin member portion is coupled to the second bracket and to the second end surface of the elongated bar, and wherein the first pin member portion is coupled to the second pin member portion.

10. The system of claim 1 wherein the first and second projections are first and second l-shaped clips, respectively.

11. A system comprising:

(I) an elongated bar;

(II) at least one protrusion extending from the elongated bar; and (III) a device case including a base with oppositely facing interior and exterior surfaces, (a) the interior surface of the base having a first surface portion occupying a portion of a first geometric plane and a second surface portion occupying a portion of a second geometric plane, the first and second geometric planes extending parallel to each other and offset from one another, (b) the base having at least one aperture extending through the base from the exterior surface of the base through to the second portion of the interior surface of the base, wherein a portion of the elongated bar directly abuts a portion of the exterior surface of the base of the device case, and wherein the elongated bar is coupled to the base of the device case by portions of the at least one protrusion extending through the at least one aperture of the base past the second portion of the interior surface without extending past the first geometric plane of the first surface portion of the interior surface of the base.

12. The system of claim 11 wherein the elongated bar further includes a height dimension, a width dimension, and a length dimension perpendicularly oriented with one another with the length dimension being greater than the height dimension and the width dimension, wherein the elongated bar includes an elongated groove, and wherein the elongated groove extends along the length dimension of the elongated bar.

13. The system of claim 11 wherein the at least one protrusion is an l-shaped clip.

14. A system for a portable electronic device comprising:

(I) an elongated bar with a flat surface;

(II) at least one protrusion perpendicularly extending from the flat surface of the elongated bar; and (III) a device case portion including a base with oppositely facing interior and exterior surfaces, (a) the interior surface of the base having first and second portions with first and second levels, respectively, the second level of the second portion displaced from the first level of the first portion as a step, (b) the base having at least one aperture extending through the base from the exterior surface of the base through to the second portion of the interior surface of the base, (c) the device case portion further having three sides perpendicularly extending with respect to the interior surface of the base to partially define an interior for containing the portable electronic device, wherein the flat surface of the elongated bar is in immediate contact with a portion of the exterior surface of the base of the device case, and wherein the elongated bar is coupled to the base of the device case by portions of the at least one protrusion extending through the first and second apertures of the base past the second portion of the interior surface of the base without extending past the first portion of the interior surface of the base thereby allowing the portable electronic device to be positioned in the interior of the device case without contacting the at least one protrusion.

15. The system of claim 14 wherein the elongated bar further includes a flat first end surface perpendicular to the flat surface of the elongated bar, wherein the elongated bar further includes a flat second end surface perpendicular to the flat surface of the elongated bar, and wherein the flat first end surface is parallel with the flat second end surface.

16. The system of claim 15 further including a strap, wherein the strap is coupled with the flat first end surface of the elongated bar, and wherein the strap is coupled with the flat second end surface of the elongated bar.

17. The system of claim 16 further including first and second brackets, wherein the strap is coupled to the flat first end surface of the elongated bar via the first bracket, and wherein the strap is coupled to the flat second end surface of the elongated bar via the second bracket.

18. The system of claim 15 wherein the flat surface of the elongated bar perpendicularly extends from the flat first end surface to the flat second end surface.

19. The system of claim 15 wherein the elongated bar includes an elongated groove, and wherein the elongated groove perpendicularly extends from the flat first end surface to the flat second end surface.

20. The system of claim 11 wherein the at least one protrusion is an l-shaped clip.

* * * * *